US006985685B2

(12) United States Patent
Shigeta et al.

(10) Patent No.: US 6,985,685 B2
(45) Date of Patent: Jan. 10, 2006

(54) DEVELOPING DEVICE AND IMAGE FORMING APPARATUS

(75) Inventors: Kunio Shigeta, Hachioji (JP); Seiko Itagaki, Hachioji (JP); Seiji Yamaguchi, Hino (JP); Toru Komatsu, Hachioji (JP); Hiroshi Akita, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 38 days.

(21) Appl. No.: 10/800,687

(22) Filed: Mar. 16, 2004

(65) Prior Publication Data

US 2004/0265009 A1 Dec. 30, 2004

(30) Foreign Application Priority Data

Jun. 26, 2003 (JP) ..... 2003-182979

(51) Int. Cl.
*G03G 15/08* (2006.01)

(52) U.S. Cl. ..... 399/254; 399/256

(58) Field of Classification Search ..... 399/254, 399/255, 256, 258, 259, 260, 263
See application file for complete search history.

(56) References Cited

U.S. PATENT DOCUMENTS

| | | | | |
|---|---|---|---|---|
| 5,722,002 | A * | 2/1998 | Kikuta et al. | 399/30 |
| 6,249,664 | B1 * | 6/2001 | Sato | 399/256 |
| 6,275,674 | B1 * | 8/2001 | Sugimoto | 399/254 |
| 6,766,132 | B2 * | 7/2004 | Sakai et al. | 399/256 |

* cited by examiner

*Primary Examiner*—Hoang Ngo
(74) *Attorney, Agent, or Firm*—Finnegan, Henderson, Farabow, Garrett & Dunner, L.L.P.

(57) ABSTRACT

A developing device has a rotary developer carrier, a rotary developer supply and collection member, a first and second rotary developer stirring members for stirring the developer while conveying and circulating the developer between them in the direction opposite to each other and having the same developer conveyance power, and a third rotary developer stirring member having a zero conveyance power in the rotary axis direction, which are provided in a housing in parallel with each other in this order in the direction to leave a latent image carrier. A toner replenishment inlet is provided at an upper part where the second and third stirring members face each other, and on an upstream side of the second stirring member in the developer conveyance direction, and the second and third stirring members are rotated downwardly at the position where both developer stirring members face each other.

11 Claims, 7 Drawing Sheets

FIG. 16 ( a )
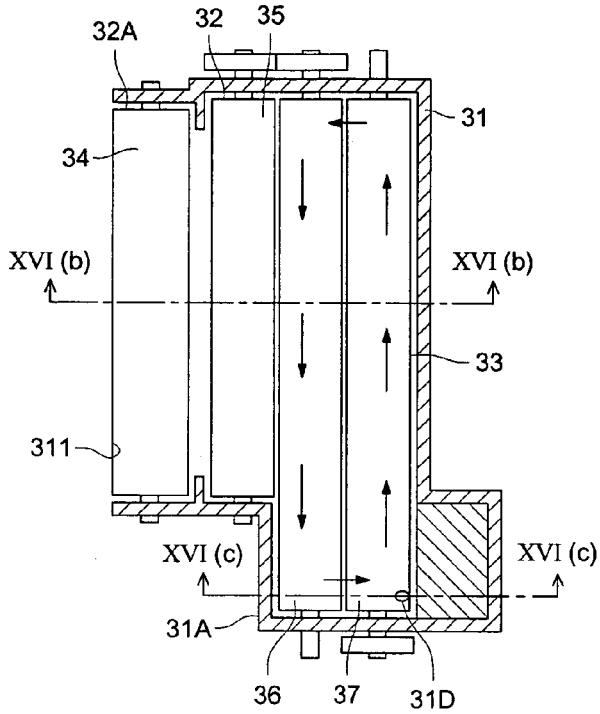
FIG. 16 ( b )
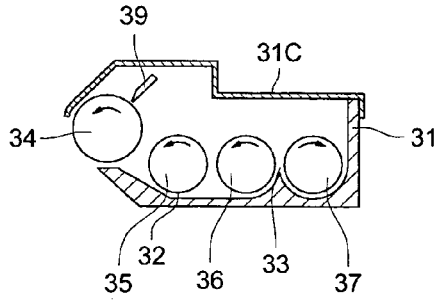
FIG. 16 ( c )
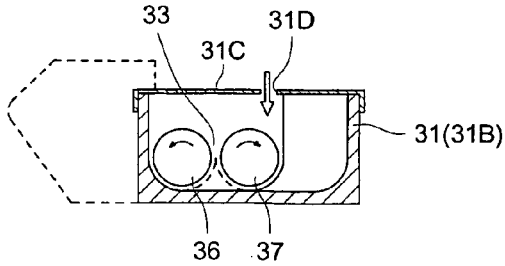

DEVELOPING DEVICE AND IMAGE FORMING APPARATUS

BACKGROUND OF THE INVENTION

The present invention relates to a developing device and to an image forming apparatus equipped with the developing device.

Presently, in an image forming apparatus of a certain type employing an electrophotographic system, there is used a developing method wherein two-component developer composed of toner and carrier, for example, is used, toner which has been subjected to frictional electrification by a proper stirring means is conveyed to a developing area, and the toner is stuck to an electrostatic latent image formed on a latent image carrier, for forming a toner image. In the developing method using the two-component developer of this kind, fresh toner is replenished, depending on an amount of toner consumption, for keeping toner concentration in the developer to be constant.

In the image forming apparatus of this kind, images are required to be of high image quality, and for this requirement, toner with small particle size has come to be used, and this trend of a small particle size of toner has made a carrier to be of a small particle size.

While it is possible to form images with high image quality by using toner with a small particle size and carrier with a small particle size, fluidity of the developer is lowered and it becomes difficult to stir the developer sufficiently, resulting in a problem that the toner newly replenished is supplied to the developing area without becoming the state to have prescribed amount of electrostatic charges, and photographic fog and toner scattering are easily caused.

The problem stated above is caused conspicuously in the case of outputting images having high printing rate continuously, for example, when forming color images.

On the other hand, in recent years, with an elevation of social consciousness for environmental protection, conservation of natural resources has been achieved including toner recycling.

However, the toner collected after being used once for development is inferior to unused toner in terms of charging characteristics, and photographic fog and toner scattering caused by insufficient amount of electrostatic charges are easily caused, which is a problem.

For the problem mentioned above, there have been proposed many technologies for improving efficiency of stirring developer, and for example, a stirring means is made to be one with the structure having high capacity of stirring developer, by providing a member that functions as an auxiliary stirring member (Japanese TOKKAIHEI Nos. 07-013420, 09-166918 and 09-288412).

In the aforementioned technologies, however, cyclic conveyance speed of developer in a developing unit is lowered in all of the technologies, though stirring efficiency for developer is improved, resulting in that toner concentration of developer to be supplied to a developer carrier for the direction of a rotation axis of the developer carrier becomes uneven, and in particular, when images with high printing rate are outputted continuously, uneven density of images tends to be caused and it is difficult to form images with high image quality surely, which is a problem.

When intending to prevent occurrence of photographic fog and toner scattering by improving stirring power for developer for the purpose of making replenished fresh toner to be in the state of having sufficient amount of charges, as stated above, there is a problem that image density unevenness caused by a decline of transportability of developer tends to occur. After all, it is difficult to solve simultaneously two problems including occurrence of photographic fog and toner scattering and occurrence of image density unevenness, which is the real situation.

SUMMARY OF THE INVENTION

The invention has been achieved based on the aforementioned situation, and its object is to provide a developing device an image forming apparatus having a novel structure capable of obtaining sufficient stirring power for developer without lowering a conveyance speed for developer and of forming surely images with high image quality accordingly.

Structure (1): A developing device having therein a rotary developer carrier that fronts a latent image carrier and conveys while carrying a developer composed of a toner and a carrier, a rotary developer supply and collection means for supplying a developer to and collecting a developer from the developer carrier, a first rotary developer stirring means for stirring a developer while conveying and circulating the developer and a second rotary developer stirring means, which are provided in a housing to be in parallel with each other in this order in the direction to leave the latent image carrier, wherein conveyance directions of the first and second developer stirring means are opposite to each other in terms of directions of rotary axes thereof, and conveyance power for the developer for each of the first and second developer stirring means is substantially identical to each other, a third rotary developer stirring means having a length in the rotary axis direction smaller than that of the second developer stirring means and having a conveyance power for the developer in a rotary axis direction that is substantially zero, is provided at the position corresponding to the upstream side portion in the conveyance direction for developer by the second developer stirring means, in the housing, in a way that the second developer stirring means and the third developer stirring means may face each other to stand side by side in the direction to leave the latent image carrier, toner replenishment inlet is provided in the housing at an upper part of a portion where the second and third developer stirring means face each other, and on an upstream side in the conveyance direction for the developer by the second developer stirring means, and the third developer stirring means is rotated so that its circumferential surface may be moved downward in the same direction as that of the second developer stirring means at the position where both developer stirring means face each other.

Structure (2): A developing device having therein a rotary developer carrier that fronts a latent image carrier and conveys while carrying a developer composed of a toner and a carrier, a rotary developer supply and collection means for supplying a developer to and collecting a developer from the developer carrier, a first rotary developer stirring means for stirring a developer while conveying and circulating the developer and a second rotary developer stirring means, which are provided in a housing to be in parallel with each other in this order in the direction to leave the latent image carrier, wherein each of the first and second developer stirring means has a stirring member extending spirally in the rotary axis direction on the entire circumference of an outer circumferential surface of a shaft member, and conveyance directions of the first and second developer stirring means are opposite to each other in terms of directions of rotary axes thereof, and conveyance power for the developer for each of the first and second developer stirring means is substantially identical to each other, a third rotary developer stirring means having a length in the rotary axis direction smaller than that of the second developer stirring means and having a conveyance power for the developer in a rotary axis direction that is substantially zero, is provided at the position corresponding to the upstream side portion in the conveyance direction for developer by the second developer stirring means, in the housing, in a way that the second developer stirring means and the third developer stirring means may face each other to stand side by side in the direction to leave the latent image carrier, a toner replenishment inlet is provided in the housing at an upper part of a portion where the second and third developer stirring means face each other, and on an upstream side in the conveyance direction for the developer by the second developer stirring means, and the third developer stirring means is provided to be inclined in the same direction each other against the shaft member under the condition that a shaft member passes through each of plural plate-shaped stirring members, and it is rotated so that its circumferential surface may be moved downward in the same direction as that of the second developer stirring means at the position where both developer stirring means face each other.

Structure (3): A developing device having therein a rotary developer carrier that fronts a latent image carrier and conveys while carrying a developer composed of a toner and a carrier, a rotary developer supply and collection means for supplying a developer to and collecting a developer from the developer carrier, a first rotary developer stirring means for stirring a developer while conveying and circulating the developer and a second rotary developer stirring means, which are provided in a housing to be in parallel with each other in this order in the direction to leave the latent image carrier, wherein each of the first and second developer stirring means has a stirring member extending spirally in the rotary axis direction on the entire circumference of an outer circumferential surface of a shaft member, and conveyance directions of the first and second developer stirring means are opposite to each other in terms of directions of rotary axes thereof, and conveyance power for the developer for each of the first and second developer stirring means is substantially identical to each other, a third rotary developer stirring means having a length in the rotary axis direction smaller than that of the second developer stirring means and having a conveyance power for the developer in a rotary axis direction that is substantially zero, is provided at the position corresponding to the upstream side portion in the conveyance direction for developer by the second developer stirring means, in the housing, in a way that the second developer stirring means and the third developer stirring means may face each other to stand side by side in the direction to leave the latent image carrier, a toner replenishment inlet is provided in the housing at an upper part of a portion where the second and third developer stirring means face each other, and on an upstream side in the conveyance direction for the developer by the second developer stirring means, and the third developer stirring means is provided with a stirring member composed of a rib provided to extend along the direction of the rotary shaft on the outer circumferential surface of the shaft member or at the position where the developer stirring means is apart radially from the shaft member, and it is rotated so that its circumferential surface may be moved downward in the same direction as that of the second developer stirring means at the position where both developer stirring means face each other.

Structure (4): In the developing devices in Structures (1)–(3), it is preferable that a circumferential surface of the developer carrier and that of the developer supply and collection means are moved in the opposite directions each other at a portion where the developer carrier and the developer supply and collection means face each other.

Structure (5): In the developing devices in Structures (1)–(4), it is preferable that a two-component developer composed of toner whose volume average particle diameter is 3–5 $\mu$m and carrier whose volume average particle diameter is 5×Dt–10×Dt ($\mu$m) when volume average particle diameter of the toner is Dt ($\mu$m) is used.

Structure (6): In an image forming apparatus having therein a latent image carrier and a toner image forming means that forms a toner image by developing a latent image formed on the latent image carrier, the toner image forming means is composed of either one of the developing devices stated in above Structures (1)–(5), and the following conditions (a) and (b) are satisfied under the assumption that a speed of movement of the latent image carrier is represented by V (mm/sec), the maximum amount of adhesion per unit area of a toner image formed on the latent image carrier is represented by M (mg/cm$^2$), the maximum width of the toner image formed on the latent image carrier in the direction perpendicular to the direction of movement of the latent image carrier is represented by L (mm), an amount of movement of developer in the rotary axis direction by the first developer stirring means is represented by W (g/sec) and the speed of rotation of the first developer stirring means is represented by R (rpm), in the image forming apparatus having therein the latent image carrier and the toner image forming means that forms a toner image by developing a latent image formed on the latent image carrier.

$$W \geqq M \times V \times L/1000 \qquad \text{Condition } (a)$$

$$R \leqq 600 \qquad \text{Condition } (b)$$

Structure (7): An image forming apparatus having therein a latent image carrier, a toner image forming means that forms a toner image by developing a latent image formed on the latent image carrier, a transfer means that transfers a toner image on the latent image carrier onto a transfer material or onto an intermediate transfer body, a cleaning means that removes toner that passes through a transfer area by the transfer means and remains on the latent image carrier, and a toner recycle means that collects the toner removed from the latent image carrier to the toner image forming means for recycling toner, wherein the toner image forming means is composed of either one of the developing devices stated in above Structures (1)–(5), in which a recycle toner mixing opening through which the toner collected by the toner recycling means is mixed is formed at the upper position of the portion where the second developer stirring means and the third developer stirring means face each other in the housing, and at the position that is located at the upstream side of the toner supply opening in the conveyance direction for developer by the second developer stirring means.

In the developing device of the invention, due to the structure wherein the speed of conveying developer is balanced by the first developer stirring means and the second developer stirring means, the third developer stirring means is provided at the position corresponding to the upstream side portion in the conveyance direction for developer by the second developer stirring means in the housing, and at the portion where the second developer stirring means and the third developer stirring means face each other, both of them are driven to rotate so that circumferential surfaces thereof facing each other may be moved in the same direction from the top to the bottom, and toner is replenished from the upper part of the portion where the two developer stirring means face each other on a free drop basis, the speed of replenishment toner for sinking into developer at the toner replenishing position is accelerated, and therefore, in the course of conveyance by the first developer stirring means and the second developer stirring means, the replenishment toner can be dispersed surely in the developer uniformly, and sufficient mixing and stirring can be conducted, and the toner can be electrified to the level where the toner has expected amount of charges (amount of electrification).

Accordingly, since developer in which toner is made to be in expected state of electrification is supplied to the developer carrier at toner concentration that is uniform in the axial direction, occurrence of photographic fog and toner scattering caused by insufficient electrification of toner can surely be prevented, and occurrence of image density unevenness on a visible image obtained is surely prevented.

Further, a length in the axial direction necessary for sufficiently obtaining the effect that the third developer stirring means disperses fresh toner uniformly in developer may be shorter than that of the second developer stirring means, which makes it possible to prevent that an image forming apparatus itself is made to be large in size by the third developer stirring means provided in the image forming apparatus.

In addition, since the third developer stirring means is one wherein the developer conveyance power in the direction of its rotation axis is substantially zero, it is possible to secure sufficient time for mixing and stirring and to charge surely the toner up to the state to have expected charges (amount of electrostatic charges) because of the structure that the developer is stirred in the circumferential direction and charging of toner is started without an occasion that the developer is replaced between the second developer stirring means and the third developer stirring means and the developer is conveyed in the rotation axis by the third developer stirring means in the course where the developer is conveyed by the second developer stirring means.

In the image forming apparatus having the structure stated above, there is provided a developing device which has the specific structure as stated above, and developing process is conducted under the state to satisfy specific operation setting conditions, and thereby, developer sufficiently mixed and stirred so that toner therein has an expected amount of electrostatic charges is supplied to a developer carrier at toner concentration that is uniform in the direction of rotation axis, and thus, a latent image on a latent image carrier is developed. Therefore, even when developers for which large quantities of toners are consumed and replenished after images with high printing rate are outputted continuously are used, or when developers containing recycled toner which is inferior to unused toner in terms of electrifying power are used, occurrence of problems such as toner scattering, photographic fog and image density unevenness can surly be avoided, and images with high image quality can be obtained surely.

BRIEF DESCRIPTION OF THE DRAWINGS

FIG. 16(*a*)–16(*c*) are illustrations showing an outline of the structure of a developing device for comparison used in experiments, and FIG. 16(*a*) is a partial sectional view, FIG. 16 (*b*) is a longitudinal sectional view taken on line XVI(b)—XVI(b) in FIG. 16(*a*) and FIG. 16(*c*) is a longitudinal sectional view taken on line XVI(c)—XVI(c) in FIG. 16(*a*).

DETAILED DESCRIPTION OF THE PREFERRED EMBODIMENT

Figure 1:
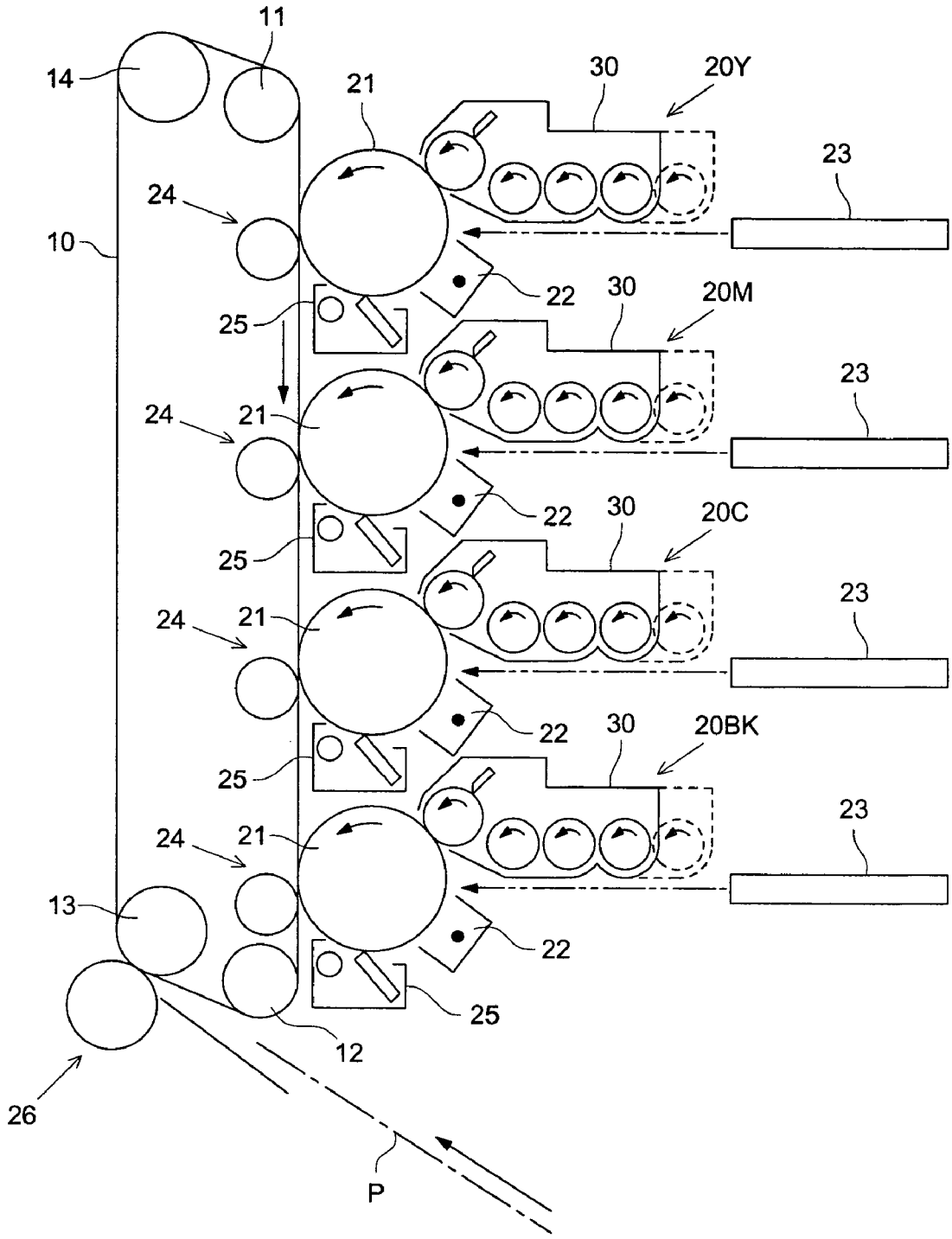
FIG. 1 is an illustration showing an outline of the structure in an example of an image forming apparatus relating to the first embodiment of the invention.

The invention will be explained in detail as follows, referring to the drawings.

First Embodiment

Figure 2:
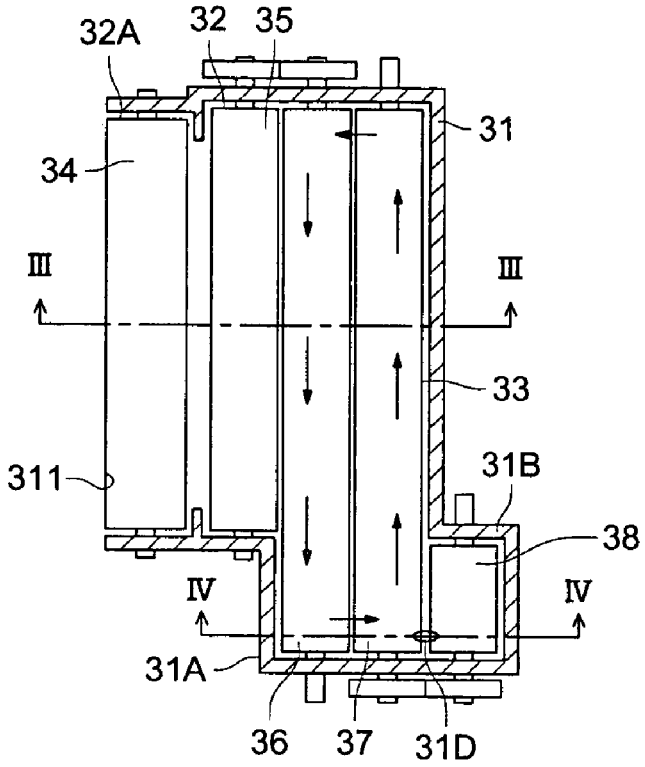
FIG. 2 is a partial sectional view showing an outline of the structure in an example of an image forming apparatus of the invention.
Figure 3:
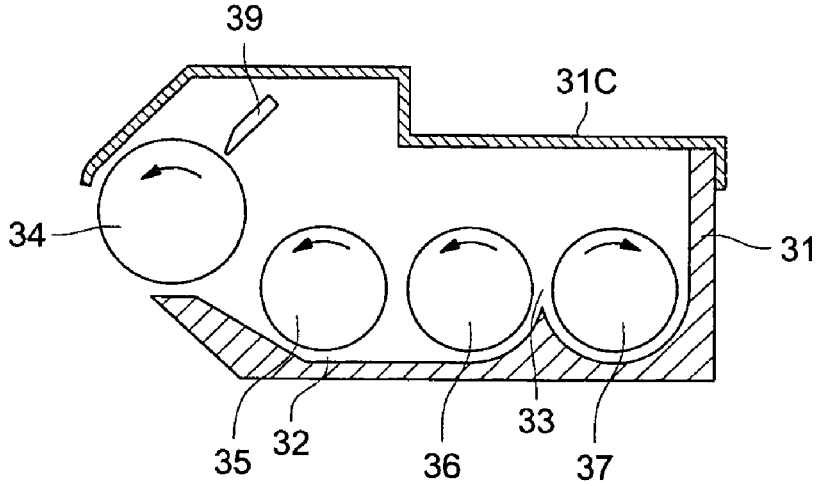
FIG. 3 is a lateral sectional view taken on line III—III in the developing device shown in FIG. 2.
Figure 4:
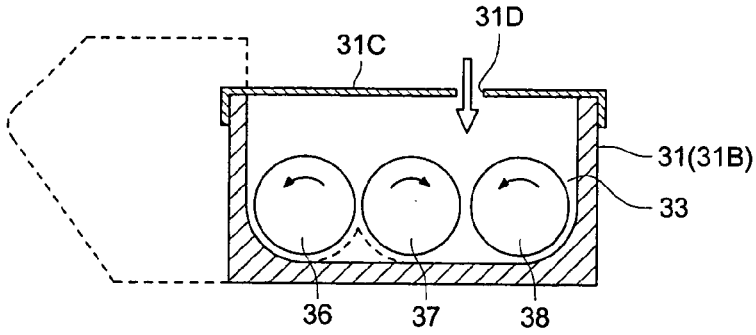
FIG. 4 is a lateral sectional view taken on line IV—IV in the developing device shown in FIG. 2.

FIG. 1 is an illustration showing an outline of the structure in an example of an image forming apparatus relating to the first embodiment of the invention, FIG. 2 is a partial sectional view showing an outline of the structure in an example of an image forming apparatus of the invention, FIG. 3 is a lateral sectional view taken on line III—III in the developing device shown in FIG. 2, and FIG. 4 is a lateral sectional view taken on line IV—IV in the developing device shown in FIG. 2.

This image forming apparatus is equipped with an intermediate transfer object in a shape of an endless belt (hereinafter referred to as "intermediate transfer belt") 10 that is trained about a group of plural supporting rollers 11, 12, 13 and 14, and along the outer circumferential surface of the intermediate transfer object 10, there are provided four toner image forming units 20Y, 20M, 20C and 20BK each forming a toner image with a different color to be away from each other so that the intermediate transfer object 10 may be moved circularly while touching each latent image carrier of the toner image forming unit relating to each color toner image, and secondary transfer mechanism 26 is provided at the position that is in a downstream side of the area of arrangement for the toner image forming units in the direction of movement of the intermediate transfer object 10.

Toner image forming unit 20Y relating to a yellow toner image is composed of drum-shaped photoreceptor 21 representing a latent image carrier, charging means 22 that is arranged along the outer circumferential surface of the photoreceptor 21 to be in the order of operations in the direction of rotation of the photoreceptor 21, exposure means 23, toner image forming means 30, primary transfer mechanism 24 and photoreceptor cleaning means 25.

Further, toner image forming units 20M, 20C and 20 BK relating respectively to a magenta toner image, a cyan toner image and a black toner image are also made to have the same structure as that of the toner image forming unit 20Y relating to the yellow toner image.

Each of the photoreceptors 21 in respective toner image forming units is composed of one wherein, for example, a light sensitive layer made of resin such as polycarbonate containing organic photoconductor is formed on the outer circumferential surface of a drum-shaped metal base body.

Each of toner image forming means 30 in respective toner image forming units is composed, for example, of a developing device having the structure shown in FIGS. 2–4. The developing device will be explained in a specific manner as follows, and in the present specification, it is assumed that the direction from side to side in FIG. 2 is mentioned as "the direction to leave the latent image carrier", the vertical direction in FIG. 2 is mentioned as "axial direction" and the vertical direction in FIG. 3 and in FIG. 4 is mentioned as "vertical direction".

The developing device is equipped with housing 31 which is formed to have the condition where developer supply and collection portion 32 and developer stirring portion 33 are formed to stand abreast in the direction to leave the latent image carrier so that the developer stirring portion 33 may be positioned to be behind photoreceptor 21, and developer carrier arrangement portion 32A having opening 311 on the wall surface from which the photoreceptor 21 is viewed ahead is formed at the position that is ahead of the developer supply and collection portion 32 in the housing 31.

On rear side portion forming the developer stirring portion 33 in the housing 31, there is formed extended portion 31A of the wall surface forming the developer supply and collection portion 32 that protrudes exceeding an outer end on one side in the axial direction.

On the developer carrier arrangement portion 32A in the housing 31, there is provided developer carrier 34 that is rotated to carry and convey developer in the circular direction to be pivoted rotatably, so that it may extend in the axial direction facing photoreceptor 21 through opening 311 in the housing 31.

The developer carrier 34 is composed of a developing sleeve that is provided to be rotatable and is made of nonmagnetic material such as, for example, aluminum and of a cylindrical magnetic body which is provided to be fixed in the developing sleeve and has, for example, a plurality of magnetic poles.

Developer supply and collection means 35 that is rotated and supplies developer to developer carrier 34 and collects toner-consumed developer to return the it to the developer stirring portion 33 together with developer carried by the developer supply and collection means 35 is provided on the developer supply and collection portion 32 to be pivoted rotatably so that it may extend in the direction of a rotary axis of the developer carrier 34.

On the developer stirring portion 33, there are provided first developer stirring means 36 and second developer stirring means 37 to be pivoted rotatably so that both of them may face and extend in the axial direction.

Figure 5:
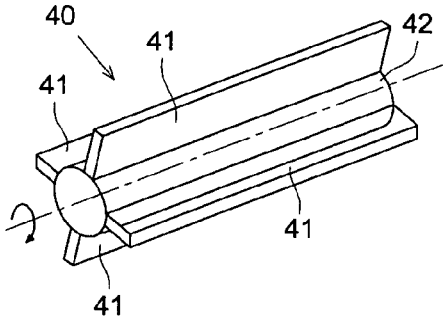
FIGS. 5(*a*) and 5(*b*) are respectively a perspective view and a side view showing a structure example of a rotary member constituting a developer supply and collection means and the third developer stirring means in the developing device shown in FIG. 2.
Figure 5:
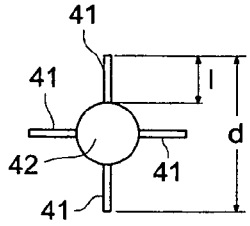

As shown in FIGS. 5(*a*) and 5(*b*), for example, the developer supply and collection means 35 is composed of crisscross paddle-shaped rotary member 40 wherein four flat blade members 41, for example, are provided to be away from each other at the same interval around the outer circumferential surface of cylindrical shaft member 42 to extend toward outer side in the radial direction of the shaft member.

It is preferable that the developer supply and collection means 35 is rotated so that it is moved in the direction opposite to that of the developer carrier 34 at the portion where the developer carrier 34 and the developer supply and collection means 35 face each other. Owing to this, developer supplied from the developer supply and collection means 35 to the developer carrier 34 can be replaced surely with developer that loses toner on the developer carrier 34 and is collected to the developer supply and collection means 35, thus, toner concentration of developer on the developer carrier 34 becomes uniform and occurrence of unevenness of image density can surely be prevented.

The first developer stirring means 36 and the second developer stirring means 37 are those which mix and stir developer while conveying it in the opposite direction to the axial direction, and they are composed of those having the same conveying capacity for developer in the axial direction, thus, developer is conveyed by both of the first developer stirring means 36 and the second developer stirring means 37 on a circulatory basis under the condition of the balanced conveyance speed.

From the viewpoint of prevention of occurrence of uneven toner concentration in the axial direction, it is preferable that each of the first developer stirring means 36 and the second developer stirring means 37 is composed of a rotary member having high conveyance power for developer in the axial direction.

Figure 6:
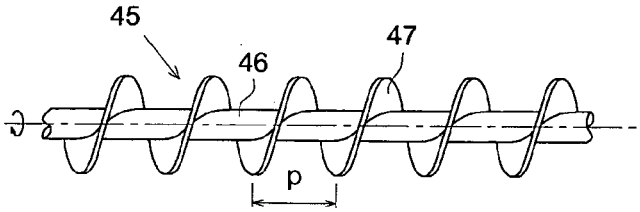
FIGS. 6(*a*) and 6(*b*) are respectively a top view and a side view showing a structure example of a rotary member constituting the first developer stirring member and the second developer stirring member in the developing device shown in FIG. 2.
Figure 6:
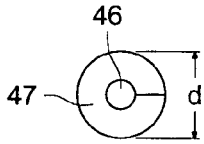

As shown in FIGS. 6(*a*) and 6(*b*), each of the first developer stirring means 36 and the second developer stirring means 37 in the present example is composed of screw-shaped rotary member 45 having stirring member 47 that is made of a spiral blade member which is formed to be extended spirally at pitch p uniform in size in the axial direction around total external circumferential surface of cylindrical shaft member 46, for example, and an end portion (portion on the lower end in FIG. 2) positioned at the downstream side in the direction of conveyance of developer is made to be a paddle-shaped one wherein a plate-shaped blade member (not shown) is provided on the outer circumferential surface of shaft member 46.

In the developing device mentioned above, on the portion corresponding to the upstream side portion in the conveyance direction for developer by the second developer stirring means 37 in housing 31, namely, on extended portion 31A of the housing 31, there is formed protruded portion 31B that forms a stirring area that is protruded backward from the rear end surface of the housing 31 to be mentioned as a preliminary stirring portion for toner to be replenished, and on this protruded portion 31B, there is provided third developer stirring means 38 that is smaller than the second developer stirring means 37 in terms of a length in the axial direction, to be pivoted rotatably to be extended in the axial direction while facing the second developer stirring means 37.

A size of an area for the axial direction of the protruded portion 31B, in other words, a length in the axial direction of the third developer stirring means 38 provided on the protruded portion 31B is not restricted in particular, and is made to be about 50–200 mm, for example, if the size is in the level at which the toner to be replenished from a toner replenishing means stated later can be dispersed in developer surely in the course of replacement of developer between the second developer stirring means 37 and the third developer stirring means 38.

The third developer stirring means 38 is composed of one wherein conveyance power for developer in the axial direction is substantially zero.

Figure 7:
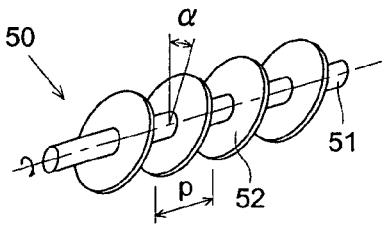
FIGS. 7(*a*) and 7(*b*) are respectively a perspective view and a side view showing a structure example of a rotary member constituting the third developer stirring means in the developing device shown in FIG. 2.
Figure 7:
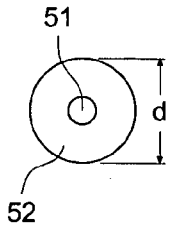

To be concrete, as shown in FIGS. 7(*a*) and 7(*b*), the third developer stirring means 38 is composed of paddle-shaped rotary member 50 wherein plural stirring members 52 each being an oval disc are provided on cylindrical shaft member 51 to be inclined in the same direction, in the manner that the shaft member passes through the oval discs, and respective stirring members 52 are provided at regular intervals of prescribed arrangement pitch p, for example.

A size of an area of stirring member 52 touching developer, size α of an angle formed between the stirring member and shaft member 51 of stirring member 52, size p of distance (arrangement pitch) for adjoining two stirring members 52 in the axial direction of 52 and other structures can be established properly depending on the purpose.

The second developer stirring means 37 and the third developer stirring means 38 are rotated by proper driving mechanism so that a circumferential surface of the second developer stirring means 37 and that of the third developer stirring means 38 may be moved in the same direction from the upper portion to the lower portion at the position where both circumferential surfaces face each other. Though the second developer stirring means 37 and the third developer stirring means 38 are interlocked in the present example, they may also be rotated by independent mechanism separately.

At the position located above top plate 31C of extended portion 31A of the housing 31 where the second developer stirring means 37 and the third developer stirring means 38 face each other, there is formed toner supply opening 31D for supplying unused toner (hereinafter referred to as "fresh toner") from an unillustrated toner replenishing mechanism to developer stirring portion 33.

The toner replenishing mechanism has a function to replenish fresh toner depending on an amount of toner consumed for developing, and this maintains the condition that toner concentration in developer is constant.

In this developing device, two-component developer composed of toner and carrier is used.

It is preferable that toner constituting two-component developer is one whose volume average particle diameter is 3–5 μm. By using small particle size toner whose volume average particle diameter is 3–5 μm, it is possible to form surely a toner image having high definition and excellent fine line reproducibility, and it is possible to form surely toner images whose image density on solid portion is stable.

It is preferable that carrier is one wherein volume average particle diameter is 5×Dt–10×Dt (μm) when volume average particle diameter of toner is Dt (μm). By using carrier whose volume average particle diameter is 5 times–10 times that of toner, it is possible to improve charge-giving power of the carrier surface even in the case of using toner with small particle size, and thereby, occurrence of photographic fog and toner scattering can surely be prevented, and it is possible to prevent surely occurrence of carrier sticking, thus, images having uniform image density, fine texture and high image quality can be obtained.

In the image forming apparatus stated above, development processing by toner image forming means 30 is conducted under the state that conditions satisfying the following condition (i) and condition (ii) have been settled.

$$W \geqq M \times V \times L/1000 \qquad \text{Condition } (i)$$

$$R \leqq 600 \qquad \text{Condition } (iii)$$

In the conditions (i) and (ii) above, V represents a circumferential speed (mm/sec) of photoreceptor 21, M represents a maximum amount of adhesion of toner image formed on photoreceptor 21 per unit area (mg/cm$^2$), L represents a maximum width (mm) of a toner image formed on photoreceptor 21 in the direction (axial direction) perpendicular to the movement direction of photoreceptor 21, W represents an amount of movement of developer (g/sec) for the axial direction by the first developer stirring means 36 and R represents a speed of rotation of the first developer stirring means 36.

When amount of movement of developer W in the axial direction by the first developer stirring means 36 is too small, toner concentration in the developer is lowered and it becomes difficult to supply sufficient amount of toner to the developing area in the developer supply area at the downstream side in the conveyance direction for developer by the first developer stirring means 36, and image density unevenness tends to be caused.

When speed of rotation R of the first developer stirring means 36 is too great, a shaft portion supported by housing 31 is heated, and thereby, developer tends to be deteriorated, and it is difficult to form surely images with high image quality.

In the image forming apparatus stated above, image forming operations are conducted as follows.

Namely, first, in each of toner image forming units 20Y, 20M, 20C and 20BK, charging processing by charging means 22 and exposure processing by exposure means 23 are conducted, and electrostatic latent images corresponding to document images are formed on photoreceptor 21, then, developing processing by toner image forming means 30 is conducted, and each toner image is formed on each of photoreceptor 21.

To be concrete, when developing processing is conducted on electrostatic latent images by toner image forming means 30, in the developer stirring portion 33, developer is mixed and stirred by two developer stirring means in the course of circulative conveyance of developer by the first developer stirring means 36 and the second developer stirring means 37, and thereby, under the state that toner has been subjected to frictional electrification to have prescribed amount of charges, developer is supplied by developer supply collection means 35 to the whole area of the surface of developer carrier 34 in the axial direction, thus, a magnetic brush is formed on developer carrier 34 and carried and conveyed in the circumferential direction. Thus, under the state that an amount of conveyance for developer is regulated to a proper amount after a bristle of the magnetic brush is cut by developer regulating member 39, the magnetic brush is brought into contact with a surface of photoreceptor 21, and developing bias that is regulated to an appropriate level is impressed, thereby, developing is carried out and toner is stuck in accordance with the electrostatic latent image formed on photoreceptor 21, thus, a toner image is formed.

The developer from which toner is consumed in the developing area is collected by developer supply and collection means 35 and is returned to developer stirring portion 33 together with developer (developer remaining on developer supply and collecting portion 32) held by developer supply and collecting means 35 without being supplied to developer carrier 34, and based on toner concentration obtained by detecting magnetic permeability of developer by a toner concentration sensor that is located at the downstream side of the first developer stirring means 36 in the conveyance direction for developer, for example, fresh toner corresponding to the consumed amount of toner is replenished to the developer stirring portion 33 by a toner replenishing mechanism.

Then, each color toner image is transferred onto intermediate transfer belt 10 by primary transfer mechanism 24 in succession to be superposed, and thereby, color toner image is formed on the transfer belt 10, and this color toner image is conveyed while it is held on the transfer belt 10 to a secondary transfer area where the color toner image is transferred by secondary transfer mechanism 26 onto transfer material P conveyed to the secondary transfer area, and after that, fixing processing is conducted by an unillustrated fixing means, and a visible image is formed.

In the image forming apparatus stated above, toner image forming means 30 keeps balance of developer conveyance with the first developer stirring means 36 and with the second developer stirring means 37, and third developer stirring means 38 is provided at the position corresponding to the upstream side of the second developer stirring means 37 in housing 31 in the developer conveyance direction, and at the portion where the second developer stirring means 37 and the third developer stirring means 38 face each other, each circumferential surface is driven to rotate to move from the upper portion to the lower portion in the regular direction, and due to the structure wherein toner is dropped from the upper position of the facing portion between the two developer stirring means on a free fall basis, the sinking speed of fresh toner into developer in the toner replenishing position is accelerated, and therefore, in the course of conveyance by the first developer stirring means 36 and the second developer stirring means 37, fresh toner can be dispersed surely in the developer uniformly, and sufficient mixing and stirring can be conducted, and the toner can be electrified to the level where the toner has prescribed amount of charges.

Namely, under the condition that fresh toner from a toner replenishing mechanism has been sunk into the developer at the extended portion 31A (replenishing position) by stirring operations of the second developer stirring means 37 and the third developer stirring means 38, replacement of developer is conducted repeatedly between the second developer stirring means 37 and the third developer stirring means 38, during the period when the developer moves in the axial direction by a certain distance, and the developer is stirred by the third developer stirring means 38 in the circumferential direction without being conveyed in the axial direction, thus, the so-called preliminary mixing and stirring are conducted and the developer is conveyed by the second developer stirring means 37 while being stirred. As a result, sufficient stirring time is secured, and occurrence of a problem that it is difficult to make toner to be in an expected electrified state promptly (to make the electrification rising characteristic to be sharp) by the structure to use rotary members having high stirring power simply as the first developer stirring means 36 and the second developer stirring means 37 alone, is surely prevented, thus, developer can be supplied by developer supply and collection means 35 to developer carrier 34 under the state wherein the toner is dispersed evenly in the developer and is in the state to have expected amount of charges (amount of electrification).

Therefore, electrostatic latent images on photoreceptor 21 are developed under the condition that developer in which toner is made to be in expected state of electrification is has been supplied to developer carrier 34 at toner concentration that is uniform in the axial direction, thus, occurrence of photographic fog and toner scattering caused by insufficient electrification of toner can surely be prevented, and occurrence of image density unevenness on a visible image obtained is surely prevented, and images with high image quality wherein image density and color balance are adjusted can surely be obtained.

Further, owing to extended portion 31A owned by housing 31, it is possible to obtain a longer circulative conveyance path for developer and to make the mixing and stirring time for developer to be longer, and further, by forming opening 31D for toner replenishing on the extended portion 31A, it is possible to surely prevent that fresh toner is supplied to a developing area under the insufficient electrification to affect adversely.

When the developing process is conducted under the state that specific conditions (i) and (ii) are satisfied, it is possible to supply developer to the developing area under the condition that toner concentration unevenness in the axial direction is zero, in other words, a toner concentration difference in the axial direction is extremely small, and images having uniform image density without image density unevenness can be obtained. Further, by setting speed of rotation R of the first developer stirring means 36 to be 600 rpm or less (condition (ii)), it is possible to prevent surely that a shaft portion is heated and developer is deteriorated when the first developer stirring means 36 is rotated at high speed.

Further, the third developer stirring means 38 is shorter than the second developer stirring means 37 in terms of a length in the axial direction that is necessary to obtain sufficient effect for dispersing fresh toner uniformly in developer, and further, the third developer stirring means 38 can utilize a space formed inevitably by providing a container that houses toner for replenishment on an image forming apparatus main body and can arrange projected portion 31B of housing 31 in a rational manner, thus, it is possible to prevent that the image forming apparatus is made to be extremely large in size by providing the third developer stirring means 38.

In the image forming apparatus having the structure stated above, toner and carrier are sufficiently mixed and stirred, sufficient toner electrification rising characteristic can be obtained, and developer can be supplied to the developing area at toner concentration that is uniform in the axial direction, as stated above, and therefore, even when developer for which a large amount of toner consumption and replenishment are conducted for outputting images with high rate of printing continuously, for example, is used, or even when image forming operations are conducted at high speed, for example, at a processing speed of 50 prints or more per one minute, photographic fog and toner scattering are not caused, and images with uniform image density without image density unevenness can be formed surely.

The preferred embodiment of the invention has been explained, and in the developing device of the invention, the structures of the first developer stirring means 36, the second developer stirring means 37 and the third developer stirring means 38 are not limited to the aforesaid structures, and when the first developer stirring means 36 and the second developer stirring means 37 have the same developer conveyance power in the axial direction and the third developer stirring means 38 has developer conveyance power in the axial direction which is substantially zero, sufficient effect in practical use can be obtained.

Figure 8:
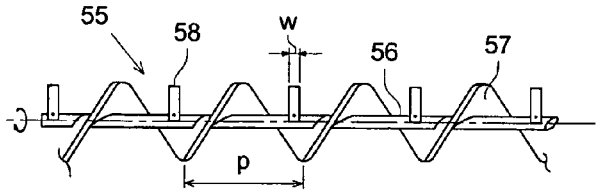
FIGS. 8(*a*) and 8(*b*) are respectively a top view and a side view showing another structure example of a rotary member constituting the first developer stirring means and the second developer stirring means.
Figure 8:
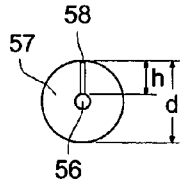
Figure 9:
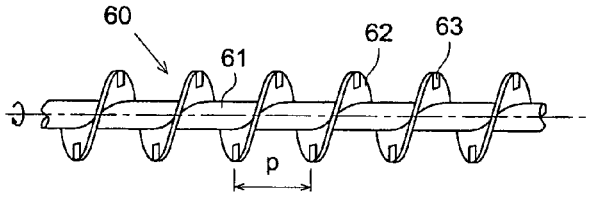
FIGS. 9(*a*) and 9(*b*) are respectively a top view and a side view showing still another structure example of a rotary member constituting the first developer stirring means and the second developer stirring means.
Figure 9:
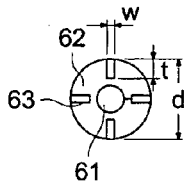

For example, the first developer stirring means 36 and the second developer stirring means 37 may also be composed respectively of rotary members having structures respectively shown by FIGS. 8(*a*) and 8(*b*) and FIGS. 9(*a*) and 9(*b*).

In the specific explanation, rotary members 55 and 60 shown respectively by FIGS. 8(*a*) and 8(*b*) and FIGS. 9(*a*) and 9(*b*) both have sufficient developer conveyance power necessary to prevent occurrence of toner concentration unevenness in the axial direction, and have higher developer stirring power than an ordinary screw-shaped rotary member 45 shown by FIGS. 6(*a*) and 6(*b*).

The rotary member 55 shown in FIGS. 8(*a*) and 8(*b*) is composed of cylindrical shaft member 56 and main stirring member 57 wherein the main stirring member 57 that is composed of a spiral blade member extending spirally at pitch p that is uniform in the axial direction is provided on the entire outer circumferential surface of the shaft member 56, and further, auxiliary stirring members 58 each being composed of a bar-shaped or sheet-shaped vertical blade member extending radially are provided on the outer circumferential surface of the shaft member 56 at a rate of one in screw pitch p, for example. In this example, the auxiliary stirring member 58 is arranged at the central position of screw pitch p in the rotary shaft direction.

The rotary member 60 shown in FIGS. 9(*a*) and 9(*b*) is composed of cylindrical shaft member 61 and stirring member 62 wherein the stirring member 62 that is composed of a spiral blade member extending spirally at pitch p in prescribed size in the axial direction is provided on the entire outer circumferential surface of the shaft member 61, and cutout 63 that extends in the axial direction through outer circumferential portions of stirring members 62 is formed thereon. In this example, the cutouts 63 are formed at a rate of four cutouts per one screw pitch to be away equally in terms of distance in the circumferential direction.

In the developing device wherein the first developer stirring means 36 and the second developer stirring means 37 are composed of the rotary members 55 and 60 as stated above, sufficient speed for conveying developer can be obtained, occurrence of toner concentration unevenness in the axial direction can be prevented for developer to be supplied to developer carrier 34, and moreover, sufficient electrification rising characteristics of toner can be obtained more steadily, and problems of toner scattering, photographic fog and image density unevenness can surely be prevented.

In the invention, the third developer stirring means 38 can make fresh toner to sink in developer to be dispersed surely, at the toner replenishing position, and as a result, have higher developer stirring power, from the viewpoint that it is preferable for the third developer stirring means 38 to sufficient toner electrification rising characteristics are obtained surely in the course of conveyance of developer by the second developer stirring means 37.

Figure 10:
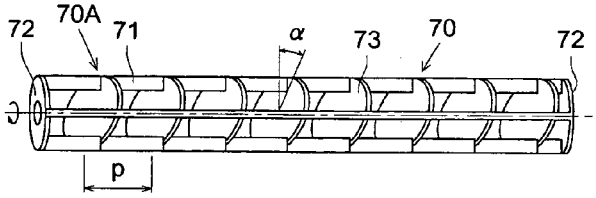
FIGS. 10(*a*) and 10(*b*) are respectively a perspective view and a side view showing another structure example of a rotary member constituting the third developer stirring means.
Figure 10:
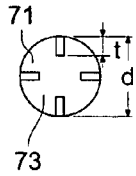
Figure 11:
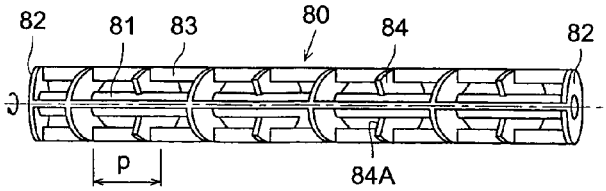
FIGS. 11(*a*) and 11(*b*) are respectively a perspective view and a side view showing still another structure example of a rotary member constituting the third developer stirring means.
Figure 11:
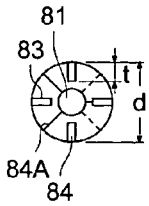

FIGS. 10(*a*) and 10(*b*) and FIGS. 11(*a*) and 11(*b*) are perspective views showing more preferred examples of the structure of the rotary member used as the third developer stirring means 38 in the developing device of the invention.

Rotary member 70 shown in FIGS. 10(*a*) and 10(*b*) is provided with frame 70A that is formed by plural (for example, 4) plate-shaped rib members 71 extending in parallel each other in the axial direction each being fixed on its both ends by disc-shaped flange members 72 and 72, and plural oval-plate-shaped stirring members 73 are supported by rib members 71 to be inclined in the same direction each other from a rotational central axis of the frame 70A, and each stirring member 73 is provided at regular intervals on placement pitch p in prescribed size.

With respect to this rotary member 70, a shaft member (not shown) extending toward the outside in the axial direction is provided on each of the flange members 72 and 72 to be pivoted on housing 31 in the developing device so that the rotary member 70 may be rotated, and owing to rotation on the center of the shaft member, developer is stirred in the circumferential direction by oval-plate-shaped stirring member 73 that functions as a main stirring member, and is stirred in the circumferential direction by rib member 71 serving as an auxiliary stirring member, in the course where developer is conveyed by the second developer stirring member 37 in developer stirring portion 33.

Rotary member 80 shown in FIGS. 11(*a*) and 11(*b*) is composed of cylindrical shaft member 81 extending in the direction of a rotational axis, two disc-shaped flange members 82 and 82 which support the shaft member 81 on its both ends, plate-shaped rib member 83 that is fixed on the flange members 82 and 82 and extends in the axial direction along the shaft member 81 at the position of each shaft member 81 and at the position where the shaft member 81 is away in its radial direction, and plural plate-shaped main stirring member 84 provided to be supported by the rib member 83 under the condition that the shaft member 81 penetrates.

Each main stirring member 84 is a disc-shaped one having cutout 84A that has a center angle in a prescribed size, and it is provided to be positioned to be apart each other at regular intervals on placement pitch p in prescribed size in the axial direction so that cutouts 84A and 84A on the two adjoining main stirring members 84 and 84 may be positioned to be opposite each other on the circumferential positions on the shaft member 81.

When the third developer stirring means 38 is composed of the rotary members 70 and 80 as stated above, a size of an area where main stirring members 73 and 84 come in touch with developer, a size of separating distance (pitch) between two adjoining main stirring members in the axial direction, a size of an area where rib members 71 and 83 come in touch with developer, and other constituting factors can be established properly in accordance with purposes.

In the developing device wherein the third developer stirring means 38 is composed of rotary members 70 and 80 having respectively auxiliary stirring members 71 and 83 as stated above, actions and effects stated above are obtained more surely, photographic fog and toner scattering caused by insufficient electrification of toner are prevented surely, and image density unevenness caused by ununiformity of toner concentration in the axial direction in developer to be supplied to developer carrier 34 can surely be prevented.

In the image forming apparatus equipped with the developing device of this kind, therefore, sufficient stirring is conducted, and developer in which toner is electrified to the level where the toner has expected amount of charges is supplied to developer carrier 34 at toner concentration uniform in the axial direction, and electrostatic latent image on photoreceptor 21 is developed, thus, the problems of toner scattering, photographic fog and image density unevenness are surely prevented, and images having high image quality can be obtained for certain.

In the foregoing, there has been explained an occasion wherein the invention is applied to the image forming apparatus for forming a color image equipped with plural toner image forming units. However, the invention is not limited to the image forming apparatus having the structure of this kind, and it can be applied effectively to those with various structures, and even in the case of applying to the image forming apparatus for forming monochrome images, for example, the actions and effects stated above are not decreased.

Second Embodiment

The image forming apparatus relating to the second embodiment of the invention is one having a toner recycle means that collects toner removed by a photoreceptor cleaning means to a toner image forming means for reusing.

Figure 12:
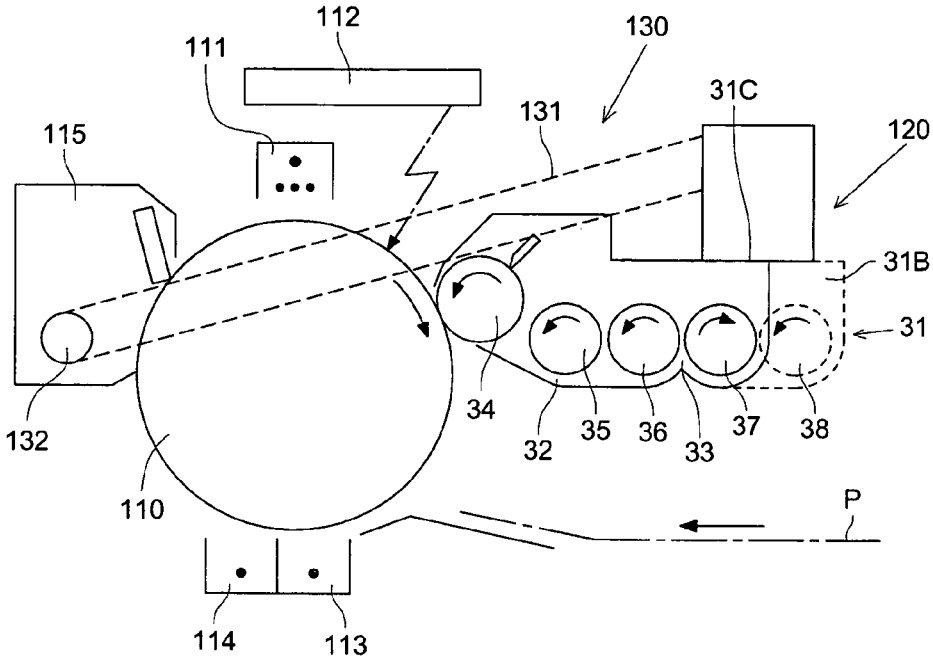
FIG. 12 is an illustration showing an outline of the structure in an example of an image forming apparatus relating to the second embodiment of the invention.

FIG. 12 is an illustration showing an outline of the structure in the image forming apparatus relating to the second embodiment of the invention.

This image forming apparatus is equipped with rotated and drum-shaped photoreceptor 110 representing a latent image carrier, and around the outer circumferential surface of the photoreceptor 110, there are arranged charging means 111, exposure means 112, toner image forming means 120, transfer means 113, separation means 114 and photoreceptor cleaning means 115 in the order of operations in the rotational direction of the photoreceptor 110. The numeral 132 in FIG. 12 is a conveyance means to convey toner scraped off the photoreceptor 110 by the photoreceptor cleaning means 115 in the axial direction of the photoreceptor 110.

Figure 13:
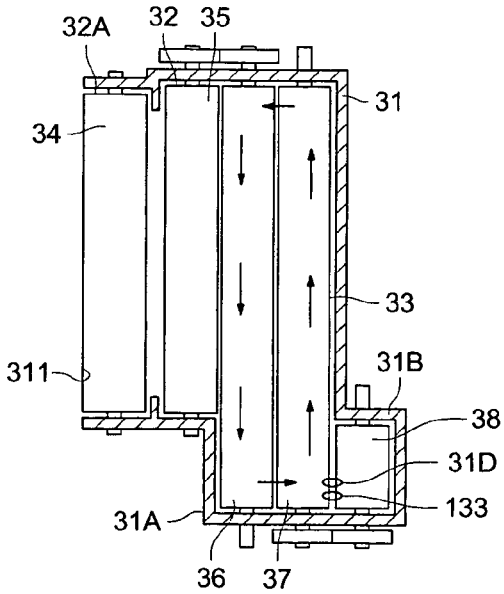
FIG. 13 is a partial sectional view showing an outline of the structure in another example of a developing device of the invention.

The basic structure of the toner image forming means 120 in this image forming apparatus is the same as that in the developing device (FIG. 2–FIG. 4) in the first embodiment as shown in FIG. 13, for example, and on the upper position of the portion where the second developer stirring member 37 and the third developer stirring member 38 face each other in top plate 31C of extended portion 31A of the housing 31 and at the position at upstream side of toner supply opening 31D in the developer conveyance direction by the second developer stirring means 37, there is formed recycle toner mixing opening 133 for mixing toner (hereinafter referred to as "recycle toner") collected by toner recycle means 130.

The position in the axial direction where recycle toner mixing opening 133 is formed is not restricted in particular, if only the position for forming toner supply opening 31D for fresh toner by toner replenishing mechanism for conveyance direction of developer by the second developer stirring means 37 and order are satisfied. However, it is preferable for practical use to be formed at the position that is upstream side by 5–30 mm of the position of forming toner supply opening 31D for the developer conveyance direction by the second developer stirring means 37.

Recycle toner is mixed in developer stirring portion 33 under the condition that an amount of supply of the recycle toner is adjusted so that the state wherein a ratio of recycle toner to fresh toner in developer (recycle toner ratio) is 50% by weight or less may be maintained.

In the developing device having the structure mentioned above, the sinking speed of fresh toner into developer in the toner replenishing position is basically accelerated by stirring operations (rotation) of the second developer stirring means 37 and the third developer stirring means 38 as stated above, and in the course where developer is conveyed by the first developer stirring means 36 and the second developer stirring means 37, toner is dispersed into developer uniformly and is mixed and stirred sufficiently without lowering the conveyance speed for developer. Thus, it is possible to supply developer to developer carrier 34 by developer supply and collection means 35 under the condition that toner is electrified to the level of having expected amount of charges (amount of electrification) at the toner concentration that is uniform in the axial direction, and furthermore, due to the arrangement that recycle toner mixing opening 133 is formed to be upstream side of toner supply opening 31D in the conveyance direction for developer, sufficient mixing and stirring are conducted even for recycle toner having lower fluidity and lower electrification characteristic (hard to be electrified, poor electrification rising) compared with fresh toner, thereby, sufficient electrification rising characteristics can be obtained even for recycle toner, and therefore, occurrence of photographic fog and toner scattering caused by electrification failure of toner can be prevented for certain, and occurrence of image density unevenness on visible images to be obtained can surely be prevented.

In the image forming apparatus equipped with the developing device of this kind, therefore, toner and carrier are mixed and stirred sufficiently, sufficient toner electrification rising characteristics can be obtained and developer can be supplied to the developing area at toner concentration that is uniform in the axial direction. Accordingly, even when the developer for which consumption of a large amount of toner and toner replenishment including recycle toner are conducted repeatedly because of continuous outputting of images with high rate of printing is used, for example, or even when image forming operations are conducted at high speed, for example, at a processing speed of 50 prints or more per one minute, photographic fog and toner scattering are not caused, and images with high image quality and uniform image density without image density unevenness can be formed surely.

Further, the third developer stirring means 38 is shorter than the second developer stirring means 37 in terms of a length in the axial direction that is necessary to obtain sufficient effect for dispersing fresh toner uniformly in developer, and further, the third developer stirring means 38 can utilize a space formed inevitably by providing a container that houses toner for replenishment and toner recycle means 130 on an image forming apparatus main body and can arrange projected portion 31B of housing 31 in a rational manner, thus, it is possible to prevent that the image forming apparatus is made to be extremely large in size by providing the third developer stirring means 38.

The embodiment of the invention has been explained above, and the invention is not limited to the aforementioned embodiment, and various modifications may be given to the embodiment.

For example, specific structures of the rotary member constituting a developer supply and collection means, a first developer stirring means, a second developer stirring means and a third developer stirring means, for example, a size of a pitch of a spiral blade member, a size of a placement pitch of a plate-shaped stirring member, a size of a mounting angle of the stirring member on a shaft member or a rotational center shaft, a shape and a size of an auxiliary stirring member, a speed of rotation of rotary member (conveyance speed in the axial direction for developer) and other constituting factors can be established properly in accordance with purposes.

Further, extended portion 31A is formed on housing 31, and projected portion 31B protruding backward is formed on the rear end portion of the extended portion 31A so that third developer stirring means 38 is arranged in the structure, however, the structure having no extended portion is also acceptable, for example, it is possible to arrange the structure wherein a partition wall is provided between a first developer stirring means and a second developer stirring means, and a rear projected portion is formed at the position corresponding to the upstream side portion in the direction of conveyance of developer by the second developer stirring means. Even in the case of the developing device of this kind, sufficient effect in practical use can be obtained.

Examples of experiments conducted for confirming effects of the invention will be explained as follows.

(Preparation of Rotary Member)

Rotary members (rotary members A–P) to be used as a developer supply and collection means, a first developer stirring means, a second developer stirring means and a third developer stirring means were prepared.

(Rotary Member A)

In accordance with the structure shown in FIG. 6(*a*) and FIG. 6(*b*), a spiral screw formed on an outer circumferential surface of a shaft member so that a spiral blade member (stirring member) may curl upward to the right (left-handed) was made, and there was made rotary member A wherein an end portion area in a length of 30 mm in the downstream side in the conveyance direction for developer by the spiral blade member was made to be in a paddle form where a stirring member composed of four flat blade members is provided to extend in a radial direction on an outer circumferential surface of a shaft member. On both end portions of the rotary member A, there were provided disc-shaped flange members each having an outside diameter of 24 mm through which a shaft member passes. Specific specifications of the rotary member A are as follows.

Maximum outside diameter (d): 24 mm, a length in the direction of rotary shaft excluding a shaft portion (a length of an area where a spiral blade member and a plate-shaped blade member are provided: 440 mm, an outside diameter of a shaft member: 6 mm, screw pitch (p) of a spiral blade member: 30 mm, and a thickness of a spiral blade member: 1 mm.

(Rotary Member B)

Rotary member B having the same structure as that in rotary member A except that the spiral blade member was formed on the outer circumferential surface of the shaft member so that it curls upward to the right (left-handed) was made.

(Rotary member C)

In accordance with the structure shown in FIG. 9(*a*) and FIG. 9(*b*), spiral blade member (stirring member) are formed on an outer circumferential surface of a shaft member so that it curls upward to the right (left-handed), and a spiral screw on which a cutout is formed on an outer edge portion of the spiral blade member is made, and there was made rotary member C wherein an end portion area in a length of 30 mm in the downstream side in the conveyance direction for developer by the spiral blade member was made to be in a paddle form where a stirring member of four flat blade members is provided to extend in a radial direction on an outer circumferential surface of a shaft member. On both end portions of the rotary member C, there were provided disc-shaped flange members each having an outside diameter of 24 mm through which a shaft member passes. Specific specifications of the rotary member C are as follows.

Maximum outside diameter (d): 24 mm, a length in the direction of rotary shaft excluding a shaft portion (a size of an area where a spiral blade member and a plate-shaped blade member are provided: 440 mm, an outside diameter of a shaft member: 6 mm, screw pitch (p) of a spiral blade member: 30 mm, a thickness of a spiral blade member: 1 mm, a length of a cutout in a radial direction (t): 5 mm, a length of a cutout in a circumferential direction (w): 2 mm and number of locations where cutouts are formed: forming four locations per pitch in circumferential direction at regular intervals.

(Rotary Member D)

In accordance with the structure shown in FIG. 8(*a*) and FIG. 8(*b*), a spiral screw having spiral blade member (main stirring member) formed on an outer circumferential surface of a shaft member to curl upward to the right (left-handed) and plural plate-shaped vertical blade members (auxiliary stirring members) extending outside in radial direction was made, and there was made rotary member D wherein an end portion area in a length of 30 mm in the downstream side in the conveyance direction for developer by the spiral blade member was made to be in a paddle form where a stirring member of four flat blade members is provided to extend in a radial direction on an outer circumferential surface of a shaft member. On both end portions of the rotary member D, there were provided disc-shaped flange members each having an outside diameter of 24 mm through which a shaft member passes. Specific specifications of the rotary member D are as follows.

Maximum outside diameter (d): 24 mm, a length in the direction of rotary shaft excluding a shaft portion (a size of an area where a spiral blade member is provided): 440 mm, an outside diameter of a shaft member: 6 mm, screw pitch (p) of a spiral blade member: 30 mm, a thickness of a spiral blade member: 1 mm, locations of vertical blade member: one per pitch at the center of a pitch of spiral blade member, a length of a vertical blade member in the direction of rotary shaft (w): 3 mm, a length of vertical blade member in a radial direction (h): 8 mm, a thickness of vertical blade member: 1 mm.

(Rotary Member E)

Rotary member E having the same structure as that in rotary member D was made with an exception that a length of the vertical blade member in the rotary shaft direction (w) was made to be 12 mm, and the vertical blade members were arranged at the center position in a pitch of the spiral blade member at regular intervals at a rate of four vertical blade members per one pitch in the circumferential direction, in the rotary member D.

(Rotary Member F)

Rotary member E having the same structure as that in rotary member D was made with an exception that a length of the vertical blade member in the rotary shaft direction (w) was made to be 20 mm, and the vertical blade member were arranged at the center position in a pitch of the spiral blade member at regular intervals at a rate of four vertical blade members per one pitch in the circumferential direction, in the rotary member D.

(Rotary Member G)

Figure 14:
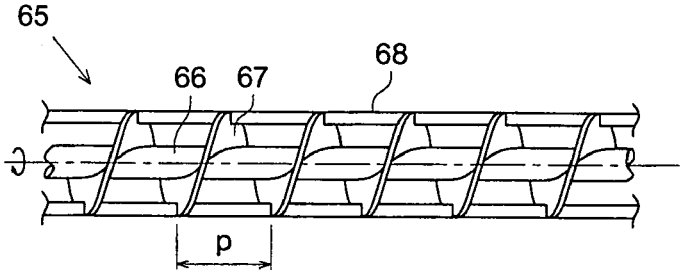
FIGS. 14(*a*) and 14(*b*) are respectively a top view and a side view showing a structure example of a rotary member used in experiment examples.
Figure 14:
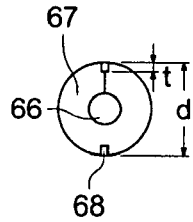

In accordance with the structure shown in FIG. 14(*a*) and FIG. 14(*b*), there was made a spiral screw (65) having spiral blade member (67) formed on an outer circumferential surface of a shaft member (66) to curl upward to the right (left-handed) and having two flat plate-shaped rib members (68) each extending in the rotary shaft direction formed at the position to face with a shaft member on the outer circumferential surface of the spiral blade member between, and there was made rotary member G wherein an end portion area in a length of 30 mm in the downstream side in the conveyance direction for developer by the spiral blade member was made to be in a paddle form where a stirring member of four flat blade members is provided to extend in a radial direction on an outer circumferential surface of a shaft member. On both end portions of the rotary member G, there were provided disc-shaped flange members each having an outside diameter of 24 mm through which a shaft member passes. Specific specifications of the rotary member G are as follows.

Maximum outside diameter: 24 mm, a length in the rotary shaft direction excluding a shaft portion (a size of an area where a spiral blade member and a plate-shaped blade member are provided): 440 mm, an outside diameter of a shaft member: 6 mm, screw pitch (p) of a spiral blade member: 30 mm, a thickness of a spiral blade member: 1 mm, a length of a rib member in a radial direction (t): 3 mm, and a thickness of the rib member: 1 mm.

(Rotary Member H)

Rotary member H having the same structure as that in rotary member G was made with an exception that a length of each rib member in the radial direction was made to be 5 mm, in the rotary member G.

(Rotary Member I)

Rotary member I having the same structure as that in rotary member G was made with an exception that four rib members were provided to be away from each other at regular intervals in the circumferential direction on the outer circumferential surface of the spiral blade member, in the rotary member G.

(Rotary Member J)

In accordance with the structure shown in FIG. 5(*a*) and FIG. 5(*b*), there was made crisscross paddle-shaped rotary member J having four flat plate-shaped rib members (stirring members) on the outer circumferential surface of the shaft member. On both end portions of the rotary member J, there were provided disc-shaped flange members each having an outside diameter of 24 mm through which a shaft member passes. Specific specifications of the rotary member J are as follows.

Maximum outside diameter (d): 24 mm, a length in the rotary shaft direction excluding a shaft portion (a length in the axial direction of an area where a stirring member is provided): 110 mm, an outside diameter of a shaft member: 6 mm, a length of a rib member in a radial direction (1): 9 mm, and a thickness of the rib member: 1 mm.

(Rotary Member K)

In accordance with the structure shown in FIG. 11(*a*) and FIG. 11(*b*), there was made paddle-shaped rotary member K having plural plate-shaped members (main stirring members) and four flat plate-shaped rib members (auxiliary stirring members) provided to extend in the rotary shaft direction at positions to be away from each other at regular intervals in the circumferential direction on an outer circumferential surface of a plate-shaped member. On both end portions of the rotary member K, there were provided disc-shaped flange members each having an outside diameter of 24 mm through which a shaft member passes. Specific specifications of the rotary member K are as follows.

Maximum outside diameter (d): 24 mm, a length in the rotary shaft direction excluding a shaft portion (a size of an area where a stirring member is provided): 110 mm, an outside diameter of a shaft member: 6 mm, placement pitch of plate-shaped member (p): 25 mm, a mounting angle for a shaft member of a plate-shaped member: 90°, a center angle of a plate-shaped member (angle area of a shaft member where a plate-shaped member is provided: 270°, a thickness of a plate-shaped member: 1 mm, a length in the radial direction of a rib member (t): 5 mm, and a thickness of a rib member: 1 mm.

(Rotary Member L)

In accordance with the structure shown in FIG. 7(*a*) and FIG. 7(*b*), there was made paddle-shaped rotary member L having plural oval plate-shaped members (stirring members). On both end portions of the rotary member L, there were provided disc-shaped flange members each having an outside diameter of 24 mm through which a shaft member passes. Specific specifications of the rotary member L are as follows.

Maximum outside diameter (d): 24 mm, a length in the rotary shaft direction excluding a shaft portion (a size of an area where oval plate-shaped members are provided): 110 mm, an outside diameter of a shaft member: 6 mm, mounting angle for shaft member of oval plate-shaped member ($\alpha$): 45°, placement pitch of oval plate-shaped member (p): 25, and a thickness of oval plate-shaped member: 1 mm.

(Rotary Member M)

In accordance with the structure shown in FIG. 10(*a*) and FIG. 10(*b*), there was made paddle-shaped rotary member M having plural oval plate-shaped members (main stirring members) and four flat plate-shaped rib members (auxiliary stirring members) provided to extend in the rotary shaft direction at positions to be away from each other at regular intervals in the circumferential direction on an outer circumferential surface of an oval plate-shaped member. On both end portions of the rotary member M, there were provided disc-shaped flange members each having an outside diameter of 24 mm through which a shaft member passes. Specific specifications of the rotary member M are as follows.

Maximum outside diameter (d): 24 mm, a length in the rotary shaft direction excluding a shaft portion (a size of an area where oval plate-shaped members are provided): 110 mm, an outside diameter of a shaft member: 6 mm, a mounting angle for a shaft member of an oval plate-shaped member ($\alpha$): 45°, placement pitch of oval plate-shaped member (p): 25 mm, a thickness of an oval plate-shaped member: 1 mm, a length in the radial direction of a rib member (t): 3 mm, and a thickness of a rib member: 1 mm.

(Rotary Member N)

Figure 15:
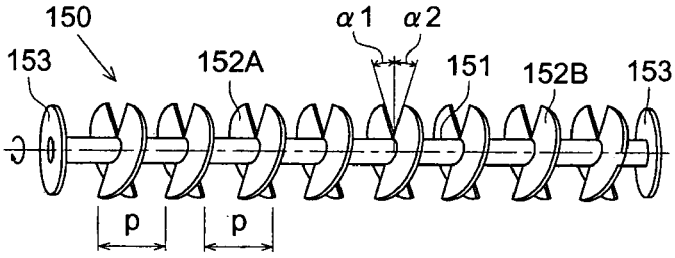
FIGS. 15(*a*) and 15(*b*) are respectively a perspective view and a side view showing a structure example of a rotary member used in experiment examples.
Figure 15:
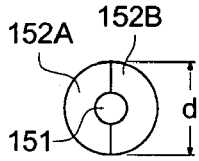

In accordance with the structure shown in FIG. 15(*a*) and FIG. 15(*b*), there was made rotary member (150) N having a first stirring member (152A) group and a second stirring member (152B) group which are composed of plural semi-oval plates provided to be along each of first and second stirring member arranging level planes each being declined in the different direction for the plane perpendicular to shaft member (151). On both end portions of the rotary member N, there were provided disc-shaped flange members each having an outside diameter of 24 mm through which a shaft member passes. Specific specifications of the rotary member N are as follows.

Maximum outside diameter (d): 24 mm, a length in the rotary shaft direction excluding a shaft portion (a size of an area where stirring members are provided): 440 mm, an outside diameter of a shaft member: 6 mm, a mounting angle for a shaft member of the first stirring member group ($\alpha$1): 45°, a mounting angle for a shaft member of the second stirring member group ($\alpha$2): 450, placement pitch of stirring member (p): 25 mm, and a thickness of a stirring member: 1 mm.

(Rotary Member O)

Rotary member O having the same structure as that in rotary member N was made with an exception that four flat plate-shaped rib members (auxiliary stirring member) each being 3 mm in terms of length in the radial direction were provided to extend in the rotary shaft direction at positions which are away from each other at regular intervals in the circumferential direction on an outer circumferential surface formed by the first stirring member and the second stirring member, in rotary member N.

(Rotary Member P)

Rotary member P having the same structure as that in rotary member J was made with an exception that a length in the rotary shaft direction excluding a shaft portion (a size of an area where a stirring member is provided) was made to be 360 mm, in rotary member J.

Experiment Example 1

(Preparation of Developing Device)

In accordance with the structure shown in FIG. 2–FIG. 4, there were made developing devices 1–6 relating to the invention wherein each of the first, second and third developer stirring means is composed of a rotary member selected in accordance with Table 1 which will be indicated later.

Further, there was made developing devices 7 for comparison wherein the second developer stirring means and the third developer stirring means selected in accordance with Table 1 which will be shown later are set to rotate so that each circumferential surface at a portion where both developer stirring means face each other is moved in the same direction from the lower portion to the upper portion.

Furthermore, as shown in FIGS. 16(*a*)–16(*c*), developing devices 8–17 for comparison wherein the structure is the same as one shown in FIG. 2 excepting that the third developer stirring means is not provided, and the first developer stirring means and the second developer stirring means are constituted with rotary members selected in accordance with combination shown in Table 1.

A direction of rotation of the first developer stirring means in Table 1 shows the direction of movement of a circumferential surface of the first developer stirring means at a portion where it faces a developer supply and collection means, and the first developer stirring means is rotated so that its circumferential surface is moved in the direction that is opposite to that for a circumferential surface of the developer supply and collection means at the portion where the first developer stirring means faces the developer supply and collection means.

An outside diameter of the developing sleeve constituting a developer carrier is 30 mm, and a length in the axial direction thereof is 330 mm.

As a developer supply and collection means, the aforementioned rotary member P (criss-cross paddle-shaped one) was used.

The position of a toner supply opening for developing devices 1–6 relating to the invention and for developing device 7 for comparison is above the portion where the second developer stirring means faces the third developer stirring means, and it is away by 15 mm toward the downstream side from an edge in the upstream side in the conveyance direction for developer by the second developer stirring means.

The position of a toner supply opening for each of developing devices 8–17 for comparison is above the side portion farther from the photoreceptor 110 of the second developer stirring means, and it is away by 15 mm toward the downstream side from an edge in the upstream side in the conveyance direction for developer by the second developer stirring means.

As developers, two-component developers having toner concentration of 7% by weight were used for all developers concerning yellow toner, magenta toner, cyan toner and black toner, and developers weighing 1100 g were filled in each of developing devices 1–6 relating to the invention and developing device 7, while, developers weighing 1000 g were filled in each of developing devices 8–17 for comparison.

Toners which were used for all of yellow toner, magenta toner, cyan toner and black toner were those wherein 0.8% by weight of large particle size silica, 0.2% by weight of small particle size silica, 0.2% by weight of large particle size titania, 0.4% by weight of small particle size titania and 0.05% by weight of calcium stearate are added to polymerized toner whose volume average particle size is 4.5±0.15 $\mu$m, and CV value (a/b×100%) shown by a standard deviation (a) of particle size distribution and by an average particle size (b) is 18±2%.

With respect to carrier, developers which are concerned to all of yellow toner, magenta toner, cyan toner and black toner and used were those wherein acrylic resin is coated on a surface of ferrite particle whose volume average particle size is 25 $\mu$m and saturation magnetization is 60 emu/g at the rate of coating amount to ferrite particle that is 3% by weight.

Each of developing devices 1–6 relating to the invention and of developing devices 7–17 for comparison was installed on an individual driving machine, and each speed of rotation for the first developer stirring means, the second developer stirring means and the third developer stirring means was established at 400 rpm, and an amount of developer moved in the axial direction by the first developer stirring means was measured. Results of the measurement are shown in the following Table 1.

The measurement of the amount of developer moved was conducted by the method wherein the developing sleeve and the developer supply and collection means were not driven, but the first, second and third developer stirring means only were driven, and a weight of developer ejected per unit time from a developer exhaust port provided on the bottom surface of a developer housing of the first developer stirring means on the downstream side in the developer conveyance direction was measured.

TABLE 1

| | Developer supply and collection means | | First developer stirring means | | | Second developer stirring means | | Third developer stirring means | | Movement direction at | Amount | Amount of |
|---|---|---|---|---|---|---|---|---|---|---|---|---|
| | Structure | Number of revolutions (rpm) | Structure | Number of revolutions (rpm) | Direction of rotation | Structure | Number of revolutions (rpm) | Structure | Number of revolutions (rpm) | Second/Third facing portion | of developer filled (g) | developer moved (g/sec) |
| *6 1 | *3 P | 400 | *3 A | 400 | *4 | *3 A | 400 | *3 L | 400 | *5 | 1100 | 76 |
| *6 2 | *3 P | 400 | *3 A | 400 | *4 | *3 A | 400 | *3 J | 400 | *5 | 1100 | 77 |
| *6 3 | *3 P | 400 | *3 A | 400 | *4 | *3 A | 400 | *3 K | 400 | *5 | 1100 | 76 |
| *6 4 | *3 P | 400 | *3 A | 400 | *4 | *3 A | 400 | *3 M | 400 | *5 | 1100 | 78 |
| *6 5 | *3 P | 400 | *3 C | 400 | *4 | *3 C | 400 | *3 L | 400 | *5 | 1100 | 56 |
| *6 6 | *3 P | 400 | *3 D | 400 | *4 | *3 D | 400 | *3 L | 400 | *4 | 1100 | 69 |
| *6 7 | *3 P | 400 | *3 B | 400 | *4 | *3 B | 400 | *3 L | 400 | — | 1100 | 81 |
| *6 8 | *3 P | 400 | *3 A | 400 | *4 | *3 A | 400 | none | | — | 1000 | 79 |
| *6 9 | *3 P | 400 | *3 C | 400 | *4 | *3 C | 400 | none | | — | 1000 | 61 |
| *6 10 | *3 P | 400 | *3 D | 400 | *4 | *3 D | 400 | none | | — | 1000 | 76 |
| *6 11 | *3 P | 400 | *3 E | 400 | *4 | *3 E | 400 | none | | — | 1000 | 40 |
| *6 12 | *3 P | 400 | *3 F | 400 | *4 | *3 F | 400 | none | | — | 1000 | 23 |
| *6 13 | *3 P | 400 | *3 G | 400 | *4 | *3 G | 400 | none | | — | 1000 | 53 |
| *6 14 | *3 P | 400 | *3 H | 400 | *4 | *3 H | 400 | none | | — | 1000 | 31 |
| *6 15 | *3 P | 400 | *3 I | 400 | *4 | *3 I | 400 | none | | — | 1000 | 34 |
| *6 16 | *3 P | 400 | *3 N | 400 | *4 | *3 N | 400 | none | | — | 1000 | 22 |
| *6 17 | *3 P | 400 | *3 O | 400 | *4 | *3 O | 400 | none | | — | 1000 | 15 |

*3; Rotary member
*4; From the bottom to the top
*5; From the top to the bottom
*6; Developing device (Image Forming Apparatus)

In accordance with the structure shown in FIG. 1, there were made image forming apparatuses 1–17 for forming color images on which the developing devices 1–6 relating to the invention and developing devices 7–17 were respectively installed, and image outputting tests were made under the following image forming conditions. The image forming conditions were established to be the same for all toner image forming units each relating to the toner image of each color.

(Image Forming Conditions)

Process speed (V): 220 mm/sec (50 sheets of images outputted per one minute)

Speed of rotation of developer supply and collection means: 400 rpm

Speed of rotation of first developer stirring means: 400 rpm

Speed of rotation of second developer stirring means: 400 rpm

Speed of rotation of third developer stirring means: 400 rpm

Number of revolutions of developing sleeve: It was adjusted within a range of 210–280 rpm so that an amount of toner adhesion per unit area on the latent image carrier becomes 0.4 mg/cm$^2$.

Closest distance between a photoreceptor and a developing sleeve (development gap): 0.3 mm Developing bias: Combination of A.C. bias and D.C. bias wherein A.C. bias is superposed on D.C. bias A.C. bias component; Vac=1 kvpp, fac=5 kHz, waveform=sine wave D.C. bias component; It was controlled to the state of Vdc=VL−500V in accordance with a result of detection of surface voltage VL on the maximum exposure portion of the photoreceptor.

Amount of developer conveyed by the developing sleeve: 25±2 mg/cm$^2$

Width of a magnetic brush formed in the axial direction of the developing sleeve: 320 mm Toner replenishment control: A toner concentration sensor (magnetic permeability sensor) was provided at the position that is upstream side by 80 mm from the edge on the downstream side in the conveyance direction of developer by the first developer stirring means, and a toner replenishment motor was controlled in accordance with results of the detection by the toner concentration sensor.

Toner replenishment speed: max. 30 g/min

Surface voltage of photoreceptor:

Maximum exposure portion voltage (VL): −50V to −100V

Charging voltage (unexposed portion voltage) (VH):

Controlled to the state of VH=Vdc−150V in accordance with established value of D.C. bias component in developing bias.

The image output tests were made under the method wherein image outputting of the following (1)–(6) were conducted repeatedly four times (total A4×2000 sheets), and the presence or absence of occurrence of photographic fog (fog of image) for characters and line patterns, the presence or absence of occurrence of character blurring, the presence or absence of occurrence of image density unevenness of solid pattern and the presence or absence of occurrence of contamination of the inside of the apparatus were evaluated based on the following evaluation standards. Results are shown in Table 2 that will be indicated later.

(1) Procedures to output 50 sheets continuously for the pattern (rate of printing 30%) of cyan (C) single-color character/line+halftone (10 steps);

(2) Procedures to output 150 sheets continuously for the solid pattern (rate of printing 80%) of cyan (C);

(3) Procedures to output 50 sheets continuously for the character/line pattern (rate of printing 7%) of cyan (C) single-color;

(4) Procedures to output 50 sheets continuously for the character/line+halftone (10 steps) pattern (rate of printing 30% for M and C) of blue (magenta (M)+cyan (C)) single-color character/line+halftone (10 steps);

(5) Procedures to output 150 sheets continuously for solid pattern (rate of printing 80% for magenta (M) and cyan (C) of blue (magenta (M)+cyan (C)) single-color; and (6) Procedures to output 50 sheets continuously for character/line pattern (rate of printing 7% for magenta (M) and cyan (C)) of blue (magenta (M)+cyan (C)) single-color.

(Evaluation Standard)

(1) Photographic fog of image:

The photographic fog of image was evaluated in the method wherein relative reflection density of a white background of character/line pattern was measured under the condition that reflection density of an unused sheet is zero, and "A" represents an occasion that relative reflection density is 0.004 or less, "B" represents an occasion that relative reflection density is more than 0.004 and is not more than 0.006 and "C" represents an occasion that relative reflection density is more than 0.006.

(2) Character blurring:

The character blurring was evaluated with sharpness of a character contour and with a degree of blurring of a character when a character in a size of 4-point having therein intricate vertical, horizontal and oblique lines such as a Chinese character meaning a bell in English (hereinafter referred to as "Bell") was enlarged and observed.

The occasion wherein a void space of a character of "Bell" is clear, a character contour is distinct and toner blurring on the peripheral portion of the character is extremely little was represented by "A", the occasion wherein a void space of a character of "Bell" lacks detail slightly (slightly filled with toner blurring), but toner blurring on the peripheral portion of the character is little was represented by "B", and the occasion wherein a void space of a character of "Bell" lacks detail (filled with toner blurring), toner blurring on the peripheral portion of the character is much and a character contour is bleeding was represented by "C".

(3) Image density unevenness:

The image density unevenness was evaluated by a color difference (distance in L*a*b*space) at optional nine locations in a page of a cyan single-color solid pattern or a blue single-color solid pattern. The occasion where the color difference at nine locations of a cyan single-color solid pattern is 3 or less and the color difference at nine locations of a blue single-color solid pattern is 7 or less was represented by "A", the occasion where the color difference at nine locations of a cyan single-color solid pattern is more than 3 and is 5 or less, and the color difference at nine locations of a blue single-color solid pattern is 7 or less, or where the color difference at nine locations of a cyan single-color solid pattern is 3 or less and the color difference at nine locations of a blue single-color solid pattern is more than 7 and is 9 or less was represented by "B" and the occasion where the color difference at nine locations of a cyan single-color solid pattern is more than 3 and the color difference at nine locations of a blue single-color solid pattern is more than 9 was represented by "C".

(4) Contamination of the Inside of the Apparatus:

The contamination of the inside of the apparatus was evaluated by removing the developing device after completion of image output tests and by observing the state of contamination in the vicinity of the location where the developing device is installed, on a visual observation basis. The occasion where no contamination of the inside of the apparatus was observed, or extremely slight contamination was observed only on the location where the developing device is installed was represented by "A", the occasion where slight contamination was observed in the vicinity of the location where the developing device is installed (for example, both end portions) represented by "B" and the occasion where contamination on the location where the developing device is installed was spread to the peripheral portion (for example, a charging device) was represented by "C".

TABLE 2

| | | Evaluation | | | |
|---|---|---|---|---|---|
| | Developing device | Photographic fog of image(1) | Character blurring(2) | Image density unevenness(3) | Contamination of the inside of the apparatus(4) |
| *1 1 | *2 1 | A | A | A | A |
| *1 2 | *2 2 | A | A | A | A |
| *1 3 | *2 3 | A | A | A | A |
| *1 4 | *2 4 | A | A | A | A |
| *1 5 | *2 5 | A | A | A | A |
| *1 6 | *2 6 | A | A | A | A |
| *1 7 | *2 7 | C | C | C | C |
| *1 8 | *2 8 | C | C | C | C |
| *1 9 | *2 9 | C | C | C | C |
| *1 10 | *2 10 | C | C | C | C |
| *1 11 | *2 11 | C | C | B | C |
| *1 12 | *2 12 | A | A | C | B |
| *1 13 | *2 13 | B | B | C | B |
| *1 14 | *2 14 | A | A | C | A |
| *1 15 | *2 15 | A | A | C | A |
| *1 16 | *2 16 | C | C | C | C |
| *1 17 | *2 17 | C | C | C | C |

*1; Image forming apparatus
*2; Developing device

Experiment Example 2

Image output tests which are the same as those in Experiment Example 1 were made with an exception that the speed of rotation of each of the developer supply and collection means, the first developer stirring means, the second developer stirring means, and the third developer stirring means of the developing device was established to 300 rpm for each of the image forming apparatuses 1–6 used in the Experiment Example 1. Results thereof are shown in the following Table 3.

TABLE 3

| | Developing device | | Evaluation | | | |
|---|---|---|---|---|---|---|
| | Structure | Amount of developer moved (g/sec) | Photographic fog of image(1) | Character blurring(2) | Image density unevenness(3) | Contamination of the inside of the apparatus(4) |
| *1 1 | *2 1 | 58 | A | A | A | A |
| *1 2 | *2 2 | 58 | A | A | A | A |
| *1 3 | *2 3 | 57 | A | A | A | A |
| *1 4 | *2 4 | 58 | A | A | A | A |
| *1 5 | *2 5 | 42 | A | A | A | A |
| *1 6 | *2 6 | 50 | A | A | A | A |

*1; Image forming apparatus
*2; Developing device 1

Experiment Example 3

(Preparation of Developing Device)

Developing devices 21–30 for comparison each having the same structure as that of each of the developing devices 18–20 relating to the invention having the same structure as that of each of the developing devices 1, 3 and 4 and of developing devices 8–17 for comparison were made with an exception that a recycle toner mixing opening was formed at the position that is upstream side of toner supply opening by 8 mm in the developer conveyance direction by the second developer stirring means, in each of the developing devices 1, 3 and 4 relating to the invention and of the developing devices 8–17 for comparison which were used in the Experiment Example 1.

In accordance with the structure shown in FIG. 12, there were made image forming apparatuses 18–30 for forming monochrome images each having a toner recycle means each carrying each of developing devices 18–20 relating to the invention and developing devices 21–30 for comparison. The toner recycle means is one composed of a conveyance means for conveying recycle toner to the developing device whose capacity in terms of maximum amount of toner conveyed per unit time is 30 g/min.

Then, there were made image output tests by repeating image output of the following (7)–(9), 8 times (total A4×2000 sheets) under the same image forming conditions as those for the toner image forming unit relating to black toner images of Experiment Example 1, with an exception that the process speed was set to 320 mm/sec (the number of sheets for image output per one minute is 65) for each of the image forming apparatuses 18–30, and the speed of rotation for each of the first developer stirring means, the second developer stirring means and the third developer stirring means was established in accordance with conditions shown in the following Table 4. Thereby, the presence or absence of occurrence of photographic fog (fog of image) for character/line patterns, the presence or absence of occurrence of character blurring and the presence or absence of occurrence of contamination of the inside of the apparatus were evaluated based on the aforementioned evaluation standards, and the presence or absence of occurrence of image density unevenness of solid pattern was evaluated based on the following evaluation standards. Results of the evaluation are shown in Table 5 that will be indicated later.

(7) Procedures to output 50 sheets continuously for the pattern (rate of printing 30%) of black (BK) single-color character/line+halftone (10 steps);

(8) Procedures to output 150 sheets continuously for the solid pattern (rate of printing 80%) of black (BK) single-color; and (9) Procedures to output 50 sheets continuously for the character/line pattern (rate of printing 7%) of black (BK) single-color.

(Evaluation Standard)

The image density unevenness was evaluated in the method wherein relative reflection density for each of optional nine locations in a page black (BK) single-color solid pattern is measured, and "A" represents an occasion that relative reflection density for the nine locations for black (BK) single-color pattern is 1.3 or more, and a difference between the maximum value and the minimum value is 0.1 or less, "B" represents an occasion that the minimum value of relative reflection density is 1.2 or more and is less than 1.3 and a difference between the maximum value and the minimum value is 0.1 or less and "C" represents an occasion that the minimum value of relative reflection density is less than 1.2 or a difference between the maximum value and the minimum value is more than 0.15.

TABLE 4

| | Developer supply and collection means | | First developer stirring means | | | Second developer stirring means | | Third developer stirring means | | Movement direction at | Amount | Amount of |
|---|---|---|---|---|---|---|---|---|---|---|---|---|
| | Structure | Number of revolutions (rpm) | Structure | Number of revolutions (rpm) | Direction of rotation | Structure | Number of revolutions (rpm) | Structure | Number of revolutions (rpm) | Second/Third facing portion | of developer filled (g) | developer moved (g/sec) |
| *6 18 | *3 P | 400 | *3 A | 400 | *4 | *3 A | 400 | *3 L | 400 | *5 | 1100 | 76 |
| *6 19 | *3 P | 400 | *3 A | 400 | *4 | *3 A | 400 | *3 J | 400 | *5 | 1100 | 77 |

TABLE 4-continued

| | Developer supply and collection means | | First developer stirring means | | | Second developer stirring means | | Third developer stirring means | | Movement direction at | Amount | Amount of |
|---|---|---|---|---|---|---|---|---|---|---|---|---|
| | Structure | Number of revolutions (rpm) | Structure | Number of revolutions (rpm) | Direction of rotation | Structure | Number of revolutions (rpm) | Structure | Number of revolutions (rpm) | Second/Third facing portion | of developer filled (g) | developer moved (g/sec) |
| *6 20 | *3 P | 400 | *3 A | 400 | *4 | *3 A | 400 | *3 M | 400 | *5 | 1100 | 78 |
| *6 21 | *3 P | 400 | *3 A | 400 | *4 | *3 A | 400 | | none | — | 1000 | 79 |
| *6 22 | *3 P | 400 | *3 C | 400 | *4 | *3 C | 400 | | none | — | 1000 | 61 |
| *6 23 | *3 P | 400 | *3 D | 400 | *4 | *3 D | 400 | | none | — | 1000 | 76 |
| *6 24 | *3 P | 650 | *3 E | 650 | *4 | *3 E | 650 | | none | — | 1000 | 65 |
| *6 25 | *3 P | 650 | *3 F | 650 | *4 | *3 F | 650 | | none | — | 1000 | 37 |
| *6 26 | *3 P | 650 | *3 G | 650 | *4 | *3 G | 650 | | none | — | 1000 | 83 |
| *6 27 | *3 P | 650 | *3 H | 650 | *4 | *3 H | 650 | | none | — | 1000 | 49 |
| *6 28 | *3 P | 650 | *3 I | 650 | *4 | *3 I | 650 | | none | — | 1000 | 50 |
| *6 29 | *3 P | 650 | *3 N | 650 | *4 | *3 N | 650 | | none | — | 1000 | 31 |
| *6 30 | *3 P | 650 | *3 O | 650 | *4 | *3 O | 650 | | none | — | 1000 | 20 |

*3; Rotary member
*4; From the bottom to the top
*5; From the top to the bottom
*6; Developing device

TABLE 5

| | Developing device | Evaluation: Photographic fog of image(1) | Character blurring(2) | Image density unevenness(3) | Contamination of the inside of the apparatus(4) |
|---|---|---|---|---|---|
| *1 18 | *2 18 | A | A | A | A |
| *1 19 | *2 19 | A | A | A | A |
| *1 20 | *2 20 | A | A | A | A |
| *1 21 | *2 21 | C | C | C | C |
| *1 22 | *2 22 | C | C | C | C |
| *1 23 | *2 23 | C | C | C | C |
| *1 24 | *2 24 | Image output test suspension | | | |
| *1 25 | *2 25 | Image output test suspension | | | |
| *1 26 | *2 26 | Image output test suspension | | | |
| *1 27 | *2 27 | Image output test suspension | | | |
| *1 28 | *2 28 | Image output test suspension | | | |
| *1 29 | *2 29 | Image output test suspension | | | |
| *1 30 | *2 30 | Image output test suspension | | | |

*1; Image forming apparatus
*2; Developing device

As is clear from the foregoing, it was confirmed that the image forming apparatus relating to the invention makes it possible to obtain sufficient electrification rising characteristics for developer, and to supply developer to the developer carrier at uniform toner concentration in the axial direction even when the developer for which consumption of a large amount of toner and toner replenishment including recycle toner are conducted repeatedly because of continuous outputting of images with high rate of printing is used, thus, occurrence of image defects such as photographic fog, character blurring and image density unevenness can surely be prevented, occurrence of contamination of the inside of the apparatus caused by toner scattering can surely be prevented, and images with high image quality can surely be formed.

In contrast to this, in the image forming apparatus for comparison, it was confirmed that problems of at least one or more of photographic fog of image, character blurring, image density unevenness and contamination of the inside of the apparatus are caused, and images with high image quality cannot be obtained surely.

In particular, in the monochrome image forming apparatus (Experiment Example 3) equipped with a toner recycle mechanism, when the structure was made to be one wherein the speed of rotation of the rotary member was raised to obtain the sufficient speed for moving developer, and thereby, to prevent occurrence of image density unevenness in the axial direction (image forming apparatuses 24–30), stirring torque was increased greatly, thus, image output tests had to be suspended and it was not possible to obtain output images. After investigating the reasons for the foregoing, it was confirmed that developer started to be fused on the shaft portion.

In the developing device of the invention, due to the structure wherein the speed of conveying developer is balanced by the first developer stirring means and the second developer stirring means, the third developer stirring means is provided at the position corresponding to the upstream side portion in the conveyance direction for developer by the second developer stirring means in the housing, and at the portion where the second developer stirring means and the third developer stirring means face each other, both of them are driven to rotate so that circumferential surfaces thereof facing each other may be moved in the same direction from the top to the bottom, and toner is replenished from the upper part of the portion where the two developer stirring means face each other on a free drop basis, the speed of replenishment toner for sinking into developer at the toner replenishing position is accelerated, and therefore, in the course of conveyance by the first developer stirring means and the second developer stirring means, the replenishment toner can be dispersed surely in the developer uniformly, and sufficient mixing and stirring can be conducted, and the toner can be electrified to the level where the toner has expected amount of charges (amount of electrification).

Accordingly, since developer in which toner is made to be in expected state of electrification is supplied to the developer carrier at toner concentration that is uniform in the axial direction, occurrence of photographic fog and toner scattering caused by insufficient electrification of toner can surely be prevented, and occurrence of image density unevenness on a visible image obtained is surely prevented.

Further, the third developer stirring means may be shorter than the second developer stirring means in terms of a length in the axial direction that is necessary to obtain sufficient effect for dispersing replenishment toner uniformly in developer, and further, a developing device can be arranged rationally by utilizing a space formed inevitably by providing a container that contains replenishment toner and a toner recycle means to be provided on an image forming apparatus main body, thus, it is possible to prevent that the image forming apparatus is made to be extremely large in size by providing the third developer stirring means.

Besides, due to the structure wherein the developer conveyance power in the axial direction of the third developer stirring means is substantially zero, replacement of developer between the second developer stirring means and the third developer stirring means is conducted in the course of conveyance of developer by the second developer stirring means, and thereby, developer is stirred in the circumferential direction without being conveyed in the direction of rotation axis by the third developer stirring means, and electrification is made to rise, it is possible to secure sufficient mixing and stirring time, and thereby to make toner to be electrified surly to the level for the toner to have expected amount of charges (amount of electrification).

In the image forming apparatus of the invention, there is provided a developing device which has the specific structure as stated above, and developing process is conducted under the state to satisfy specific operation setting conditions, and thereby, developer sufficiently mixed and stirred so that toner therein has an expected amount of electrostatic charges is supplied to a developer carrier at toner concentration that is uniform in the direction of rotation axis, and thus, a latent image on a latent image carrier is developed. Therefore, even when developers for which large quantities of toners are consumed and replenished after images with high printing rate are outputted continuously are used, or when developers containing recycled toner which is inferior to unused toner in terms of electrifying power are used, occurrence of problems such as toner scattering, photographic fog and image density unevenness can surly be avoided, and images with high image quality can be obtained surely.

What is claimed is:

1. A developing device comprising:

(a) a rotary developer carrier facing a latent image carrier for carrying a developer comprising a toner and a carrier;

(b) a rotary developer supply and collection member for supplying the developer to and collecting from the developer carrier;

(c) a first rotary developer stirring member for stirring the developer while conveying and circulating the developer;

(d) a second rotary developer stirring member for stirring the developer while conveying and circulating the developer between the first and second developer stirring members, wherein the developer carrier, the developer supply and collection member, the first developer stirring member and the second developer stirring member are arranged in a housing in parallel with each other in this order in a direction leaving the latent image carrier, and wherein conveyance directions of the developer of the first and second developer stirring members are opposite to each other with respect to rotary axis directions thereof, and conveyance power for the developer thereof is substantially identical to each other;

(e) a third rotary developer stirring member for stirring the developer, having a length in a rotary axis direction smaller than that of the second developer stirring member and a conveyance power for the developer in a rotary axis direction that is substantially zero, provided facing the second developer stirring member at a position corresponding to an upstream portion of and farther than the second developer stirring member in the housing; and (f) a toner replenishment inlet through which a new toner is replenished, provided in the housing at an upper position of a part where circumferential surfaces of the second and third developer stirring members face each other, and on an upstream side in the conveyance direction of the developer of the second developer stirring member, wherein the third developer stirring member is rotated so that the circumferential surface thereof moves downward in the same direction as that of the circumferential surface of the second developer stirring member at the position where the circumferential surfaces of the second and third developer stirring members face each other.

2. The developing device of claim 1, wherein each of the first and second developer stirring members comprises a shaft and a stirring member extending spirally in the rotary direction over an outer circumferential surface of the shaft, and wherein the third developer stirring member comprises a shaft and a plurality of plate-shaped stirring members provided to be inclined to the shaft in the same direction, and through each of which the shaft passes.

3. The developing device of claim 1, wherein each of the first and second developer stirring members comprises a shaft and a stirring member extending spirally in the rotary direction over an outer circumferential surface of the shaft, and wherein the third developer stirring member comprises a shaft and ribs extending along the rotary axis direction, provided at positions spaced apart from an outer circumferential surface of the shaft in a radial direction of the shaft.

4. The developing device of claim 1, wherein circumferential surfaces of the developer carrier and the developer supply and collection member move in an opposite direction to each other at a part where the circumferential surfaces of the developer carrier and the developer supply and collection member face each other.

5. The developing device of claim 1, wherein the developer is a two-component developer comprising a toner having a volume average particle diameter of 3 to 5 $\mu$m, and a carrier having a volume average particle diameter of 5×Dt $\mu$m to 10×Dt $\mu$m, where Dt ($\mu$m) represents the volume average particle diameter of the toner.

6. The developing device of claim 2, wherein circumferential surfaces of the developer carrier and the developer supply and collection member move in an opposite direction to each other at a part where the circumferential surfaces of the developer carrier and the developer supply and collection member face each other.

7. The developing device of claim 2, wherein the developer is a two-component developer comprising a toner having a volume average particle diameter of 3 to 5 $\mu$m, and a carrier having a volume average particle diameter of 5×Dt $\mu$m to 10×Dt $\mu$m, where Dt ($\mu$m) represents the volume average particle diameter of the toner.

8. The developing device of claim 3, wherein circumferential surfaces of the developer carrier and the developer supply and collection member move in an opposite direction to each other at a part where the circumferential surfaces of the developer carrier and the developer supply and collection member face each other.

9. The developing device of claim 3, wherein the developer is a two-component developer comprising a toner having a volume average particle diameter of 3 to 5 $\mu$m, and a carrier having a volume average particle diameter of 5×Dt $\mu$m to 10×Dt $\mu$m, where Dt ($\mu$m) represents the volume average particle diameter of the toner.

10. An image forming apparatus comprising:

(a) a latent image carrier for carrying an electrostatic latent image; and (b) a toner image forming device for forming a toner image by developing the electrostatic latent image formed on the latent image carrier, having the developing device according to claim 1, wherein the following conditions (i) and (ii) are satisfied, $$W \geqq M \cdot V \cdot L/1000 \quad (i), \text{ and}$$

$$R \leqq 600 \quad (ii)$$

where V (mm/s) represents a circumferential moving speed of the latent image carrier, M (mg/cm$^2$) represents a maximum amount of adhesion per unit area of a toner image formed on the latent image carrier, L (mm) represents a maximum width of the toner image formed on the latent image carrier in a direction perpendicular to a circumferential moving direction, W (g/s) represents an amount of movement of the developer with respect to the rotary axis direction of the first developer stirring member, and R (rpm) represents a speed of rotation of the first developer stirring member.

11. An image forming apparatus comprising:

(a) a latent image carrier for carrying an electrostatic latent image;

(b) a toner image forming device for forming a toner image by developing the electrostatic latent image formed on the latent image carrier, having the developing device according to claim 1, wherein the developing device further comprises a recycling toner mixing opening for mixing a collected toner with the developer, that is provided in the housing at the upper position of the part where circumferential surfaces of the second and third developer stirring members face each other, and on an upstream side of the opening through which the new toner is replenished, with respect to the conveyance direction of the developer of the second developer stirring member;

(c) a transfer device for transferring the toner image on the latent image carrier onto a transfer material or an intermediate transfer body;

(d) a cleaning device for removing the toner remained on the latent image carrier after passed through a transfer region by the transfer device; and (e) a toner recycling device for collecting the toner removed from the latent image carrier by the cleaning device back to the recycling toner mixing opening of the developing device in the toner image forming device to reutilize.

* * * * *